US006383561B1

(12) United States Patent
Moffat et al.

(10) Patent No.: US 6,383,561 B1
(45) Date of Patent: May 7, 2002

(54) BALLISTIC AEROSOL MARKING PROCESS EMPLOYING MARKING MATERIAL COMPRISING VINYL RESIN AND POLY(3,4-ETHYLENEDIOXYTHIOPHENE)

(75) Inventors: Karen A. Moffat, Brantford; Maria N. V. McDougall, Burlington, both of (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/723,778

(22) Filed: Nov. 28, 2000

(51) Int. Cl.[7] ..... B05D 5/12; B05D 1/02
(52) U.S. Cl. ..... 427/180; 427/256
(58) Field of Search ..... 427/180, 256

(56) References Cited

U.S. PATENT DOCUMENTS

| | | | | | |
|---|---|---|---|---|---|
| 5,035,926 | A | | 7/1991 | Jonas et al. | 427/393.1 |
| 5,202,211 | A | | 4/1993 | Vercoulen et al. | 430/109 |
| 5,348,832 | A | | 9/1994 | Sacripante et al. | 430/109.4 |
| 5,403,689 | A | * | 4/1995 | Odell et al. | 430/110 |
| 5,403,693 | A | | 4/1995 | Patel et al. | 430/137.14 |
| 5,457,001 | A | | 10/1995 | Van Ritter | 430/110 |
| 5,834,080 | A | | 11/1998 | Mort et al. | 428/36.91 |
| 5,853,906 | A | | 12/1998 | Hsieh | 428/690 |
| 6,013,404 | A | * | 1/2000 | Feng et al. | 430/106.6 |
| 6,203,727 | B1 | * | 3/2001 | Babinec et al. | 252/500 |

FOREIGN PATENT DOCUMENTS

| | | | |
|---|---|---|---|
| EP | 0636943 | A1 | 2/1995 |
| EP | 636943 | A1 * | 2/1995 |
| EP | 1134620 | A1 * | 9/2001 |
| JP | 61-141452 | | 6/1986 |
| JP | 3-100561 | | 4/1991 |

OTHER PUBLICATIONS

Res.Discl., 373, 356, 1995.*
*Research Disclosure*, No. 37349, No. 373, May 1995, Kenneth Mason Publications, LTD, England, p. 356.
Caplus Abstract Acc No. 1992:13303 describing JP 3–100561, Apr. 1991.
Japanese Patent Office Abstract describing JP 3–100561, Apr. 1991.
Caplus Abstract Acc. No. 1986:616683 describing JP 61–141452, Jun. 1986.

* cited by examiner

*Primary Examiner*—Erma Cameron
(74) *Attorney, Agent, or Firm*—Judith L. Byorick

(57) ABSTRACT

Disclosed is a process for depositing marking material onto a substrate which comprises (a) providing a propellant to a head structure, said head structure having at least one channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises toner particles which comprise a vinyl resin, an optional colorant, and poly(3,4-ethylenedioxythiophene), said toner particles having an average particle diameter of no more than about 10 microns and a particle size distribution of GSD equal to no more than about 1.25, wherein said toner particles are prepared by an emulsion aggregation process, said toner particles having an average bulk conductivity of at least about $10^{-11}$ Siemens per centimeter.

31 Claims, 8 Drawing Sheets

BALLISTIC AEROSOL MARKING PROCESS EMPLOYING MARKING MATERIAL COMPRISING VINYL RESIN AND POLY(3,4-ETHYLENEDIOXYTHIOPHENE)

CROSS REFERENCES TO RELATED APPLICATIONS

Copending U.S. application Ser. No. 09/408,606, filed Sep. 30, 1999, entitled "Marking Materials and Marking Processes Therewith," with the named inventors Richard P. Veregin, Carl P. Tripp, Maria N. McDougall, and T. Brian McAneney, the disclosure of which is totally incorporated herein by reference, discloses an apparatus for depositing a particulate marking material onto a substrate, comprising (a) a printhead having defined therein at least one channel, each channel having an inner surface and an exit orifice with a width no larger than about 250 microns, the inner surface of each channel having thereon a hydrophobic coating material; (b) a propellant source connected to each channel such that propellant provided by the propellant source can flow through each channel to form propellant streams therein, said propellant streams having kinetic energy, each channel directing the propellant stream through the exit orifice toward the substrate; and (c) a marking material reservoir having an inner surface, said inner surface having thereon the hydrophobic coating material, said reservoir containing particles of a particulate marking material, said reservoir being communicatively connected to each channel such that the particulate marking material from the reservoir can be controllably introduced into the propellant stream in each channel so that the kinetic energy of the propellant stream can cause the particulate marking material to impact the substrate, wherein either (i) the marking material particles of particulate marking material have an outer coating of the hydrophobic coating material; or (ii) the marking material particles have additive particles on the surface thereof, said additive particles having an outer coating of the hydrophobic coating material; or (iii) both the marking material particles and the additive particles have an outer coating of the hydrophobic coating material.

Copending U.S. application Ser. No. 09/410,271, filed Sep. 30, 1999, entitled "Marking Materials and Marking Processes Therewith," with the named inventors Karen A. Moffat, Richard P. Veregin, Maria N. McDougall, Philip D. Floyd, Jaan Noolandi, T. Brian McAneney, and Daniele C. Boils-Boissier, the disclosure of which is totally incorporated herein by reference, discloses a process for depositing marking material onto a substrate which comprises (a) providing a propellant to a head structure, said head structure having a channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises particles which comprise a resin and a colorant, said particles having an average particle diameter of no more than about 7 microns and a particle size distribution of GSD equal to no more than about 1.25, wherein said particles are prepared by an emulsion aggregation process.

Copending U.S. application Ser. No. 09/585,044, filed Jun. 1, 2000, entitled "Marking Material and Ballistic Aerosol Marking Process for the Use Thereof," with the named inventors Maria N. V. McDougall, Richard P. N. Veregin, and Karen A. Moffat, the disclosure of which is totally incorporated herein by reference, discloses a marking material comprising (a) toner particles which comprise a resin and a colorant, said particles having an average particle diameter of no more than about 7 microns and a particle size distribution of GSD equal to no more than about 1.25, wherein said toner particles are prepared by an emulsion aggregation process, and (b) hydrophobic conductive metal oxide particles situated on the toner particles. Also disclosed is a process for depositing marking material onto a substrate which comprises (a) providing a propellant to a head structure, said head structure having a channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises (a) toner particles which comprise a resin and a colorant, said particles having an average particle diameter of no more than about 7 microns and a particle size distribution of GSD equal to no more than about 1.25, wherein said toner particles are prepared by an emulsion aggregation process, and (b) hydrophobic conductive metal oxide particles situated on the toner particles.

Copending U.S. application Ser. No. 09/723,577 filed concurrently herewith, entitled "Ballistic Aerosol Marking Process Employing Marking Material Comprising Vinyl Resin and Poly(3,4-ethylenedioxypyrrole)," with the named inventors Karen A. Moffat, Rina Carlini, Maria N. V. McDougall, and Paul J. Gerroir, the disclosure of which is totally incorporated herein by reference, discloses a process for depositing marking material onto a substrate which comprises (a) providing a propellant to a head structure, said head structure having at least one channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises toner particles which comprise a vinyl resin, an optional colorant, and poly(3,4-ethylenedioxypyrrole), said toner particles having an average particle diameter of no more than about 10 microns and a particle size distribution of GSD equal to no more than about 1.25, wherein said toner particles are prepared by an emulsion aggregation process, said toner particles having an average bulk conductivity of at least about $10^{-11}$ Siemens per centimeter.

Copending U.S. application Ser. No. 09/724,458, filed concurrently herewith, entitled "Toner Compositions Comprising Polythiophenes," with the named inventors Karen A. Moffat, Maria N. V. McDougall, Rina Carlini, Dan A. Hays, Jack T. Lestrange, and Paul J. Gerroir, the disclosure of which is totally incorporated herein by reference, discloses a toner comprising particles of a resin and an optional colorant, said toner particles having coated thereon a polythiophene. Another embodiment is directed to a process which comprises (a) generating an electrostatic latent image on an imaging member, and (b) developing the latent image by contacting the imaging member with charged toner particles comprising a resin and an optional colorant, said toner particles having coated thereon a polythiophene.

Copending U.S. application Ser. No. 09/723,839, filed concurrently herewith, entitled "Toner Compositions Comprising Polypyrroles," with the named inventors Karen A. Moffat, Maria N. V. McDougall, Rina Carlini, Dan A. Hays, Jack T. Lestrange, and James R. Combes, the disclosure of which is totally incorporated herein by reference, discloses a toner comprising particles of a resin and an optional colorant, said toner particles having coated thereon a polypyrrole. Another embodiment is directed to a process which comprises (a) generating an electrostatic latent image on an imaging member, and (b) developing the latent image by contacting the imaging member with charged toner particles comprising a resin and an optional colorant, said toner particles having coated thereon a polypyrrole.

Copending U.S. application Ser. No. 09/723,787, filed concurrently herewith, entitled "Ballistic Aerosol Marking Process Employing Marking Material Comprising Polyester Resin and Poly(3,4-ethylenedioxythiophene)," with the named inventors Rina Carlini, Karen A. Moffat, Maria N. V. McDougall, and Danielle C. Boils-Boissier, the disclosure of which is totally incorporated herein by reference, discloses a process for depositing marking material onto a substrate which comprises (a) providing a propellant to a head structure, said head structure having at least one channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises toner particles which comprise a polyester resin, an optional colorant, and poly(3,4-ethylenedioxythiophene), said toner particles having an average particle diameter of no more than about 10 microns and a particle size distribution of GSD equal to no more than about 1.25, wherein said toner particles are prepared by an emulsion aggregation process, said toner particles having an average bulk conductivity of at least about $10^{-11}$ Siemens per centimeter.

Copending U.S. application Ser. No. 09/723,834, filed concurrently herewith, entitled "Ballistic Aerosol Marking Process Employing Marking Material Comprising Polyester Resin and Poly(3,4-ethylenedioxypyrrole)," with the named inventors Karen A. Moffat, Rina Carlini, and Maria N. V. McDougall, the disclosure of which is totally incorporated herein by reference, discloses a process for depositing marking material onto a substrate which comprises (a) providing a propellant to a head structure, said head structure having at least one channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises toner particles which comprise a polyester resin, an optional colorant, and poly(3,4-ethylenedioxypyrrole), said toner particles having an average particle diameter of no more than about 10 microns and a particle size distribution of GSD equal to no more than about 1.25, wherein said toner particles are prepared by an emulsion aggregation process, said toner particles having an average bulk conductivity of at least about $10^{-11}$ Siemens per centimeter.

Copending U.S. application Ser. No. 09/724,064, filed concurrently herewith, entitled "Toner Compositions Comprising Polyester Resin and Poly(3,4-ethylenedioxythiophene)," with the named inventors Karen A. Moffat, Rina Carlini, Maria N. V. McDougall, Dan A. Hays, and Jack T. Lestrange, the disclosure of which is totally incorporated herein by reference, discloses a toner comprising particles of a polyester resin, an optional colorant, and poly(3,4-ethylenedioxythiophene), wherein said toner particles are prepared by an emulsion aggregation process. Another embodiment is directed to a process which comprises (a) generating an electrostatic latent image on an imaging member, and (b) developing the latent image by contacting the imaging member with charged toner particles comprising a polyester resin, an optional colorant, and poly(3,4-ethylenedioxythiophene), wherein said toner particles are prepared by an emulsion aggregation process.

Copending U.S. application Ser. No. 09/723,851, filed concurrently herewith, entitled "Toner Compositions Comprising Vinyl Resin and Poly(3,4-ethylenedioxypyrrole)," with the named inventors Karen A. Moffat, Maria N. V. McDougall, Rina Carlini, Dan A. Hays, Jack T. Lestrange, and Paul J. Gerroir, the disclosure of which is totally incorporated herein by reference, discloses a toner comprising particles of a vinyl resin, an optional colorant, and poly(3,4-ethylenedioxypyrrole), wherein said toner particles are prepared by an emulsion aggregation process. Another embodiment is directed to a process which comprises (a) generating an electrostatic latent image on an imaging member, and (b) developing the latent image by contacting the imaging member with charged toner particles comprising a vinyl resin, an optional colorant, and poly(3,4-ethylenedioxypyrrole), wherein said toner particles are prepared by an emulsion aggregation process.

Copending U.S. application Ser. No. 09/723,907, filed concurrently herewith, entitled "Toner Compositions Comprising Polyester Resin and Poly(3,4-ethylenedioxypyrrole)," with the named inventors Karen A. Moffat, Rina Carlini, Maria N. V. McDougall, Dan A. Hays, and Jack T. Lestrange, the disclosure of which is totally incorporated herein by reference, discloses a toner comprising particles of a polyester resin, an optional colorant, and poly(3,4-ethylenedioxypyrrole), wherein said toner particles are prepared by an emulsion aggregation process. Another embodiment is directed to a process which comprises (a) generating an electrostatic latent image on an imaging member, and (b) developing the latent in image by contacting the imaging member with charged toner particles comprising a polyester resin, an optional colorant, and poly(3,4-ethylenedioxypyrrole), wherein said toner particles are prepared by an emulsion aggregation process.

Copending U.S. application Ser. No. 09/724,013, filed concurrently herewith, entitled "Toner Compositions Comprising Vinyl Resin and Poly(3,4-ethylenedioxythiophene)," with the named inventors Karen A. Moffat, Maria N. V. McDougall, Rina Carlini, Dan A. Hays, Jack T. Lestrange, and Paul J. Gerroir, the disclosure of which is totally incorporated herein by reference, discloses a toner comprising particles of a vinyl resin, an optional colorant, and poly(3,4-ethylenedioxythiophene), wherein said toner particles are prepared by an emulsion aggregation process. Another embodiment is directed to a process which comprises (a) generating an electrostatic latent image on an imaging member, and (b) developing the latent image by contacting the imaging member with charged toner particles comprising a vinyl resin, an optional colorant, and poly(3,4-ethylenedioxythiophene), wherein said toner particles are prepared by an emulsion aggregation process.

Copending U.S. application Ser. No. 09/723,654, filed concurrently herewith, entitled "Process for Controlling Triboelectric Charging," with the named inventors Karen A. Moffat, Maria N. V. McDougall, and James R. Combes, the disclosure of which is totally incorporated herein by reference, discloses a process which comprises (a) dispersing into a solvent (i) toner particles comprising a resin and an optional colorant, and (ii) monomers selected from pyrroles, thiophenes, or mixtures thereof; and (b) causing, by exposure of the monomers to an oxidant, oxidative polymerization of the monomers onto the toner particles, wherein subsequent to polymerization, the toner particles are capable of being charged to a negative or positive polarity, and wherein the polarity is determined by the oxidant selected.

Copending U.S. application Ser. No. 09/723,911, filed concurrently herewith, entitled "Toner Compositions Comprising Polyester Resin and Polypyrrole," with the named inventors James R. Combes, Karen A. Moffat, and Marid N. V. McDougall, the disclosure of which is totally incorporated herein by reference, discloses a toner comprising particles of a polyester resin, an optional colorant, and polypyrrole, wherein said toner particles are prepared by an emulsion aggregation process. Another embodiment is directed to a process which comprises (a) generating an electrostatic latent image on an imaging member, and (b) developing the latent image by contacting the imaging member with charged toner particles comprising a polyester resin, an optional colorant, and polypyrrole, wherein said toner particles are prepared by an emulsion aggregation process.

BACKGROUND OF THE INVENTION

The present invention is directed to an imaging process. More specifically, the present invention is directed to a ballistic aerosol marking process using specific marking materials. One embodiment of the present invention is directed to a process for depositing marking material onto a substrate which comprises (a) providing a propellant to a head structure, said head structure having at least one channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises toner particles which comprise a vinyl resin, an optional colorant, and poly(3,4-ethylenedioxythiophene), said toner particles having an average particle diameter of no more than about 10 microns and a particle size distribution of GSD equal to no more than about 1.25, wherein said toner particles are prepared by an emulsion aggregation process, said toner particles having an average bulk conductivity of at least about $10^{-11}$ Siemens per centimeter.

Ink jet is currently a common printing technology. There are a variety of types of ink jet printing, including thermal ink jet printing, piezoelectric ink jet printing, and the like. In ink jet printing processes, liquid ink droplets are ejected from an orifice located at one terminus of a channel. In a thermal ink jet printer, for example, a droplet is ejected by the explosive formation of a vapor bubble within an ink bearing channel. The vapor bubble is formed by means of a heater, in the form of a resistor, located on one surface of the channel.

Several disadvantages can be associated with known ink jet systems. For a 300 spot-per-inch (spi) thermal ink jet system, the exit orifice from which an ink droplet is ejected is typically on the order of about 64 microns in width, with a channel-to-channel spacing (pitch) of typically about 84 microns; for a 600 dpi system, width is typically about 35 microns and pitch is typically about 42 microns. A limit on the size of the exit orifice is imposed by the viscosity of the fluid ink used by these systems. It is possible to lower the viscosity of the ink by diluting it with increasing amounts of liquid (such as water) with an aim to reducing the exit orifice width. The increased liquid content of the ink, however, results in increased wicking, paper wrinkle, and slower drying time of the ejected ink droplet, which negatively affects resolution, image quality (such as minimum spot size, intercolor mixing, spot shape), and the like. The effect of this orifice width limitation is to limit resolution of thermal ink jet printing, for example to well below 900 spi, because spot size is a function of the width of the exit orifice, and resolution is a function of spot size.

Another disadvantage of known ink jet technologies is the difficulty of producing grayscale printing. It is very difficult for an ink jet system to produce varying size spots on a printed substrate. If one lowers the propulsive force (heat in a thermal ink jet system) so as to eject less ink in an attempt to produce a smaller dot, or likewise increases the propulsive force to eject more ink and thereby to produce a larger dot, the trajectory of the ejected droplet is affected. The altered trajectory in turn renders precise dot placement difficult or impossible, and not only makes monochrome grayscale printing problematic, it makes multiple color grayscale ink jet printing impracticable. In addition, preferred grayscale printing is obtained not by varying the dot size, as is the case for thermal ink jet, but by varying the dot density while keeping a constant dot size.

Still another disadvantage of common ink jet systems is rate of marking obtained. Approximately 80 percent of the time required to print a spot is taken by waiting for the ink jet channel to refill with ink by capillary action. To a certain degree, a more dilute ink flows faster, but raises the problem of wicking, substrate wrinkle, drying time, and the like, discussed above.

One problem common to ejection printing systems is that the channels may become clogged. Systems such as thermal ink jet which employ aqueous ink colorants are often sensitive to this problem, and routinely employ non-printing cycles for channel cleaning during operation. This cleaning is required, since ink typically sits in an ejector waiting to be ejected during operation, and while sitting may begin to dry and lead to clogging.

Ballistic aerosol marking processes overcome many of these disadvantages. Ballistic aerosol marking is a process for applying a marking material to a substrate, directly or indirectly. In particular, the ballistic aerosol marking system includes a propellant which travels through a channel, and a marking material that is controllably (i.e., modifiable in use)

introduced, or metered, into the channel such that energy from the propellant propels the marking material to the substrate. The propellant is usually a dry gas that can continuously flow through the channel while the marking apparatus is in an operative configuration (i.e., in a power-on or similar state ready to mark). Examples of suitable propellants include carbon dioxide gas, nitrogen gas, clean dry ambient air, gaseous products of a chemical reaction, or the like; preferably, nonoxic propellants are employed, although in certain embodiments, such as devices enclosed in a special chamber or the like, a broader range of propellants can be tolerated. The system is referred to as "ballistic aerosol marking" in the sense that marking is achieved by in essence launching a non-colloidal, solid or semi-solid particulate, or alternatively a liquid, marking material at a substrate. The shape of the channel can result in a collimated (or focused) flight of the propellant and marking material onto the substrate.

The propellant can be introduced at a propellant port into the channel to form a propellant stream. A marking material can then be introduced into the propellant stream from one or more marking material inlet ports. The propellant can enter the channel at a high velocity. Alternatively, the propellant can be introduced into the channel at a high pressure, and the channel can include a constriction (for example, de Laval or similar converging/diverging type nozzle) for converting the high pressure of the propellant to high velocity. In such a situation, the propellant is introduced at a port located at a proximal end of the channel (the converging region), and the marking material ports are provided near the distal end of the channel (at or further down-stream of the diverging region), allowing for introduction of marking material into the propellant stream.

In the situation where multiple ports are provided, each port can provide for a different color (for example, cyan, magenta, yellow, and black), pre-marking treatment material (such as a marking material adherent), post-marking treatment material (such as a substrate surface finish material, for example, matte or gloss coating, or the like), marking material not otherwise visible to the unaided eye (for example, magnetic particle-bearing material, ultraviolet-fluorescent material, or the like) or other marking material to be applied to the substrate. Examples of materials suitable for pre-marking treatment and post-marking treatment include polyester resins (either linear or branched); poly (styrenic) homopolymers; poly(acrylate) and poly (methacrylate) homopolymers and mixtures thereof; random copolymers of styrenic monomers with acrylate, methacrylate, or butadiene monomers and mixtures thereof; polyvinyl acetals; poly(vinyl alcohol)s; vinyl alcohol-vinyl acetal copolymers; polycarbonates; mixtures thereof; and the like. The marking material is imparted with kinetic energy from the propellant stream, and ejected from the channel at an exit orifice located at the distal end of the channel in a direction toward a substrate.

One or more such channels can be provided in a structure which, in one embodiment, is referred to herein as a printhead. The width of the exit (or ejection) orifice of a channel is typically on the order of about 250 microns or smaller, and preferably in the range of about 100 microns or smaller. When more than one channel is provided, the pitch, or spacing from edge to edge (or center to center) between adjacent channels can also be on the order of about 250 microns or smaller, and preferably in the range of about 100 microns or smaller. Alternatively, the channels can be staggered, allowing reduced edge-to-edge spacing. The exit orifice and/or some or all of each channel can have a circular, semicircular, oval, square, rectangular, triangular or other cross-sectional shape when viewed along the direction of flow of the propellant stream (the channel's longitudinal axis).

The marking material to be applied to the substrate can be transported to a port by one or more of a wide variety of ways, including simple gravity feed, hydrodynamic, electrostatic, ultrasonic transport, or the like. The material can be metered out of the port into the propellant stream also by one of a wide variety of ways, including control of the transport mechanism, or a separate system such as pressure balancing, electrostatics, acoustic energy, ink jet, or the like.

The marking material to be applied to the substrate can be a solid or semi-solid particulate material, such as a toner or variety of toners in different colors, a suspension of such a marking material in a carrier, a suspension of such a marking material in a carrier with a charge director, a phase change material, or the like. Preferably the marking material is particulate, solid or semi-solid, and dry or suspended in a liquid carrier. Such a marking material is referred to herein as a particulate marking material. A particulate marking material is to be distinguished from a liquid marking material, dissolved marking material, atomized marking material, or similar non-particulate material, which is generally referred to herein as a liquid marking material. However, ballistic aerosol marking processes are also able to utilize such a liquid marking material in certain applications.

Ballistic aerosol marking processes also enable marking on a wide variety of substrates, including direct marking on non-porous substrates such as polymers, plastics, metals, glass, treated and finished surfaces, and the like. The reduction in wicking and elimination of drying time also provides improved printing to porous substrates such as paper, textiles, ceramics, and the like. In addition, ballistic aerosol marking processes can be configured for indirect marking, such as marking to an intermediate transfer member such as a roller or belt (which optionally can be heated), marking to a viscous binder film and nip transfer system, or the like.

The marking material to be deposited on a substrate can be subjected to post-ejection modification, such as fusing or drying, overcoating, curing, or the like. In the case of fusing, the kinetic energy of the material to be deposited can itself be sufficient effectively to melt the marking material upon impact with the substrate and fuse it to the substrate. The substrate can be heated to enhance this process. Pressure rollers can be used to cold-fuse the marking material to the substrate. In-flight phase change (solid-liquid-solid) can alternatively be employed. A heated wire in the particle path is one way to accomplish the initial phase change. Alternatively, propellant temperature can accomplish this result. In one embodiment, a laser can be employed to heat and melt the particulate material in-flight to accomplish the initial phase change. The melting and fusing can also be electrostatically assisted (i.e., retaining the particulate material in a desired position to allow ample time for melting and fusing into a final desired position). The type of particulate can also dictate the post-ejection modification. For example, ultraviolet curable materials can be cured by application of ultraviolet radiation, either in flight or when located on the material-bearing substrate.

Since propellant can continuously flow through a channel, channel clogging from the build-up of material is reduced (the propellant effectively continuously cleans the channel). In addition, a closure can be provided that isolates the channels from the environment when the system is not in use. Alternatively, the printhead and substrate support (for example, a platen) can be brought into physical contact to effect a closure of the channel. Initial and terminal cleaning cycles can be designed into operation of the printing system to optimize the cleaning of the channel(s). Waste material cleaned from the system can be deposited in a cleaning station. It is also possible, however, to engage the closure against an orifice to redirect the propellant stream through the port and into the reservoir thereby to flush out the port.

Further details on the ballistic aerosol marking process are disclosed in, for example, Copending U.S. application Ser. No. 09/163,893, filed Sep. 30, 1998, with the named inventors Gregory B. Anderson, Steven B. Bolte, Dan A. Hays, Warren B. Jackson, Gregory J. Kovacs, Meng H. Lean, Jaan Noolandi, Joel A. Kubby, Eric Peeters, Raj B. Apie, Philip D. Floyd, An-Chang Shi, Frederick J. Endicott, Armin R. Volkel, and Jonathan A. Small, entitled "Ballistic Aerosol Marking Apparatus for Marking a Substrate," Copending U.S. application Ser. No. 09/164,124, filed Sep. 30, 1998, with the named inventors Gregory B. Anderson, Steven B. Bolte, Dan A. Hays, Warren B. Jackson, Gregory J. Kovacs, Meng H. Lean, Joan Noolandi, Joel A. Kubby, Eric Peeters, Raj B. Apte, Philip D. Floyd, An-Chang Shi, Frederick J. Endicott, Armin R. Volkel, and Jonathan A. Small, entitled "Method of Marking a Substrate Employing a Ballistic Aerosol Marking Apparatus," Copending U.S. application Ser. No. 09/164,250, filed Sep. 30, 1998, with the named inventors Gregory B. Anderson, Danielle C. Boils, Steven B. Bolte, Dan A. Hays, Warren B. Jackson, Gregory J. Kovacs, Meng H. Lean, T. Brian McAneney, Maria N. V. McDougall, Karen A. Moffat, Joan Noolandi, Richard P. N. Veregin, Paul D. Szabo, Joel A. Kubby, Eric Peeters, Raj B. Apte, Philip D. Floyd, An-Chang Shi, Frederick J. Endicott, Armin R. Volkel, and Jonathan A. Small, entitled "Ballistic Aerosol Marking Apparatus for Treating a Substrate," Copending U.S. application Ser. No. 09/163,808, filed Sep. 30, 1998, with the named inventors Gregory B. Anderson, Danielle C. Boils, Steven B. Bolte, Dan A. Hays, Warren B. Jackson, Gregory J. Kovacs, Meng H. Lean, T. Brian McAneney, Maria N. V. McDougall, Karen A. Moffat, Joan Noolandi, Richard P. N. Veregin, Paul D. Szabo, Joel A. Kubby, Eric Peeters, Raj B. Apte. Philip D. Floyd, An-Chang Shi, Frederick J. Endicott, Armin R. Volkel, and Jonathan A. Small, entitled "Method of Treating a Substrate Employing a Ballistic Aerosol Marking Apparatus," Copending U.S. application Ser. No. 09/163,765, filed Sep. 30, 1998, with the named inventors Gregory B. Anderson, Steven B. Bolte, Dan A. Hays, Warren B. Jackson, Gregory J. Kovacs, Meng H. Lean, Joan Noolandi, Joel A. Kubby, Eric Peeters, Raj B. Apte, Philip D. Floyd, An-Chang Shi, Frederick J. Endicott, Armin R. Volkel, and Jonathan A. Small, entitled "Cartridge for Use in a Ballistic Aerosol Marking Apparatus," Copending U.S. application Ser. No. 09/163,839, filed Sep. 30, 1998, with the named inventors Abdul M. Elhatem, Dan A. Hays, Joan Noolandi, Kaiser H. Wong, Joel A. Kubby, Tuan Anh Vo, and Eric Peeters, entitled "Marking Material Transport," Copending U.S. application Ser. No. 09/163,954, filed Sep. 30, 1998, with the named inventors Gregory B. Anderson, Andrew A. Berlin, Steven B. Bolte, Ga Neville Connell, Dan A. Hays, Warren B. Jackson, Gregory J. Kovacs, Meng H. Lean, Jaan Noolandi, Joel A. Kubby, Eric Peeters, Raj B. Apte, Philip D. Floyd, An-Chang Shi, Frederick J. Endicott, Armin R. Volkel, and Jonathan A. Small, entitled "Ballistic Aerosol Marking Apparatus for Marking with a Liquid Material," Copending U.S. application Ser. No. 09/163,924, filed in Sep. 30, 1998, with the named inventors Gregory B. Anderson, Andrew A. Berlin, Steven B. Bolte, Ga Neville Connell, Dan A. Hays, Warren B. Jackson, Gregory J. Kovacs, Meng H. Lean, Joan Noolandi, Joel A. Kubby, Eric Peeters, Raj B. Apte, Philip D. Floyd, An-Chang Shi, Frederick J. Endicott, Armin R. Volkel, and Jonathan A. Small, entitled "Method for Marking with a Liquid Material Using a Ballistic Aerosol Marking Apparatus," Copending U.S. application Ser. No. 09/163,825, filed Sep. 30, 1998, with the named inventor Kaiser H. Wong, entitled "Multi-Layer Organic Overcoat for Electrode Grid," Copending U.S. application Ser. No. 09/164,104, filed Sep.30, 1998, with the named inventors T. Brian McAneney, Joan Noolandi, and An-Chang Shi. entitled "Kinetic Fusing of a Marking Material," U.S. application Ser. No. 09/163,904 (now U.S. Pat. No. 6,116,718), filed Sep. 30, 1998, with the named inventors Meng H. Lean, Joan Noolandi, Eric Peeters, Raj B. Apte, Philip D. Floyd, and Armin R. Volkel, entitled "Print Head for Use in a Ballistic Aerosol Marking Apparatus," Copending application U.S. Ser. No. 09/163,799, filed Sep. 30, 1998, with the named inventors Meng H. Lean, Jaan Noolandi, Eric Peeters, Raj B. Apte, Philip D. Floyd, and Armin R. Volkel, entitled "Method of Making a Print Head for Use in a Ballistic Aerosol Marking Apparatus," Copending U.S. application Ser. No. 09/163,664, filed Sep. 30, 1998, with the named inventors Bing R. Hsieh, Kaiser H. Wong, and Tuan Anh Vo, entitled "Organic Overcoat for Electrode Grid," and Copending U.S. application Ser. No. 09/163,518, filed Sep. 30, 1998, with the named inventors Kaiser H. Wong and Tuan Anh Vo, entitled "Inorganic Overcoat for Particulate Transport Electrode Grid", the disclosures of each of which are totally incorporated herein by reference.

U.S. Pat. No. 5,834,080 (Mort et al.), the disclosure of which is totally incorporated herein by reference, discloses controllably conductive polymer compositions that may be used in electrophotographic imaging developing systems, such as scavengeless or hybrid scavengeless systems or liquid image development systems. The conductive polymer compositions includes a charge-transporting material (particularly a charge-transporting, thiophene-containing polymer or an inert elastomeric polymer, such as a butadiene- or isoprene-based copolymer or an aromatic polyether-based polyurethane elastomer, that additionally comprises charge transport molecules) and a dopant capable of accepting electrons from the charge-transporting material. The invention also relates to an electrophotographic printing machine, a developing apparatus, and a coated transport member, an intermediate transfer belt, and a hybrid compliant photoreceptor comprising a composition of the invention.

U.S. Pat. No. 5,853,906 (Hsieh), the disclosure of which is totally incorporated herein by reference, discloses a conductive coating comprising an oxidized oligomer salt, a charge transport component, and a polymer binder, for example, a conductive coating comprising an oxidized tetratolyidiamine salt of the formula

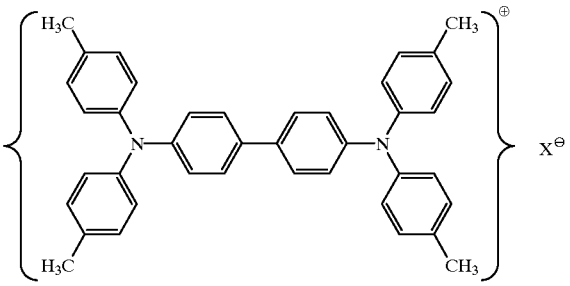

a charge transport component, and a polymer binder, wherein X- is a monovalent anion.

U.S. Pat. No. 5,457,001 (Van Ritter), the disclosure of which is totally incorporated herein by reference, discloses an electrically conductive toner powder, the separate particles of which contain thermoplastic resin, additives conventional in toner powders, such as coloring constituents and possibly magnetically attractable material, and an electrically conductive protonized polyaniline complex, the protonized polyaniline complex preferably having an electrical conductivity of at least 1 S/cm, the conductive complex being distributed over the volume of the toner particles or present in a polymer-matrix at the surface of the toner particles.

U.S. Pat. No. 5,202,211 (Vercoulen et al.), the disclosure of which is totally incorporated herein by reference, discloses a toner powder comprising toner particles which carry on their surface and/or in an edge zone close to the surface fine particles of electrically conductive material consisting of fluorine-doped tin oxide. The fluorine-doped tin oxide particles have a primary particle size of less than 0.2 micron and a specific electrical resistance of at most 50 ohms.meter. The fluorine content of the tin oxide is less than 10 percent by weight, and preferably is from 1 to 5 percent by weight.

U.S. Pat. No. 5,035,926 (Jonas et al.), the disclosure of which is totally incorporated herein by reference, discloses new polythiophenes containing structural units of the formula

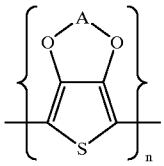

in which A denotes an optionally substituted $C_1$–$C_4$ alkylene radical, their preparation by oxidative polymerization of the corresponding thiophenes, and the use of the polythiophenes for imparting antistatic properties on substrates which only conduct electrical current poorly or not at all, in particular on plastic mouldings, and as electrode material for rechargeable batteries.

While known compositions and processes are suitable for their intended purposes, a need remains for improved marking processes. In addition, a need remains for improved ballistic aerosol marking materials and processes. Further, a need remains for ballistic aerosol marking materials and processes that enable the printing of very small pixels, enabling printing resolutions of 900 dots per inch or more. Additionally, there is a need for ballistic aerosol marking materials and processes in which the possibility of the marking material clogging the printing channels is reduced. There is also a need for ballistic aerosol marking processes wherein the marking material does not become undesirably charged. In addition, there is a need for ballistic aerosol marking processes wherein the marking material exhibits desirable flow properties. Further, there is a need for ballistic aerosol marking processes wherein the marking material contains particles of desirably small particle size and desirably narrow particle size distribution. Additionally, there is a need for ballistic aerosol marking processes wherein the marking material can obtain a low degree of surface charge without becoming so highly charged that the material becomes agglomerated or causes channel clogging. A need also remains for ballistic aerosol marking processes wherein the marking material is semi-conductive or conductive (as opposed to insulative) and capable of retaining electrostatic charge. In addition, a need remains for ballistic aerosol marking processes wherein the marking materials have sufficient conductivity to provide for inductive charging to enable toner transport and gating into the printing channels. Further, a need remains for ballistic aerosol marking processes wherein the marking materials can be selected to control the level of electrostatic charging and conductivity, thereby preventing charge build up in the BAM subsystems, controlling relative humidity, and maintaining excellent flow. Additionally, a need remains for ballistic aerosol marking processes wherein the marking materials have desirably low melting temperatures. There is also a need for ballistic aerosol marking processes wherein the marking materials have tunable melt and gloss properties, wherein the same monomers can be used to generate marking materials that have different melt and gloss characteristics by varying polymer characteristics such as molecular weight ($M_w$, $M_n$, $M_{WD}$, or the like) or crosslinking. In addition, there is a need for ballistic aerosol marking processes wherein the marking materials have desirable glass transition temperatures for enabling efficient transfer of the marking material from an intermediate transfer or transfuse member to a print substrate. Further, there is a need for ballistic aerosol marking processes wherein the marking materials have desirable glass transition temperatures for enabling efficient transfer of the marking material from a heated intermediate transfer or transfuse member to a print substrate. Additionally, there is a need for ballistic aerosol marking processes wherein the marking materials have a wide range of colors with desirable color characteristics. A need also remains for ballistic aerosol marking processes wherein the marking materials exhibit good transparency characteristics. In addition, a need remains for ballistic aerosol marking processes wherein the marking materials exhibit good fusing performance. Further, a need remains for ballistic aerosol marking processes wherein the marking material forms images with low toner pile heights, even for full color superimposed images. Additionally, a need remains for ballistic aerosol marking processes wherein the marking material comprises a resin particle encapsulated with a conductive polymer, wherein the conductive polymer is chemically bound to the particle surface. There is also a need for ballistic aerosol marking processes wherein the marking material comprises particles that have tunable morphology in that the particle shape can be selected to be spherical, highly irregular, or the like.

SUMMARY OF THE INVENTION

The present invention is directed to a process for depositing marking material onto a substrate which comprises (a) providing a propellant to a head structure, said head structure having at least one channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises toner particles which comprise a vinyl resin, an optional colorant, and poly(3,4-ethylenedioxythiophene), said toner particles having an average particle diameter of no more than about 10 microns and a particle size distribution of GSD equal to no more than about 1.25, wherein said toner particles are prepared by an emulsion aggregation process, said toner particles having an average bulk conductivity of at least about $10^{-11}$ Siemens per centimeter.

DETAILED DESCRIPTION OF THE INVENTION

In the following detailed description, numeric ranges are provided for various aspects of the embodiments described, such as pressures, velocities, widths, lengths, and the like. These recited ranges are to be treated as examples only, and are not intended to limit the scope of the claims hereof. In addition, a number of materials are identified as suitable for various aspects of the embodiments, such as for marking materials, propellants, body structures, and the like. These recited materials are also to be treated as exemplary, and are not intended to limit the scope of the claims hereof.

Figure 1:
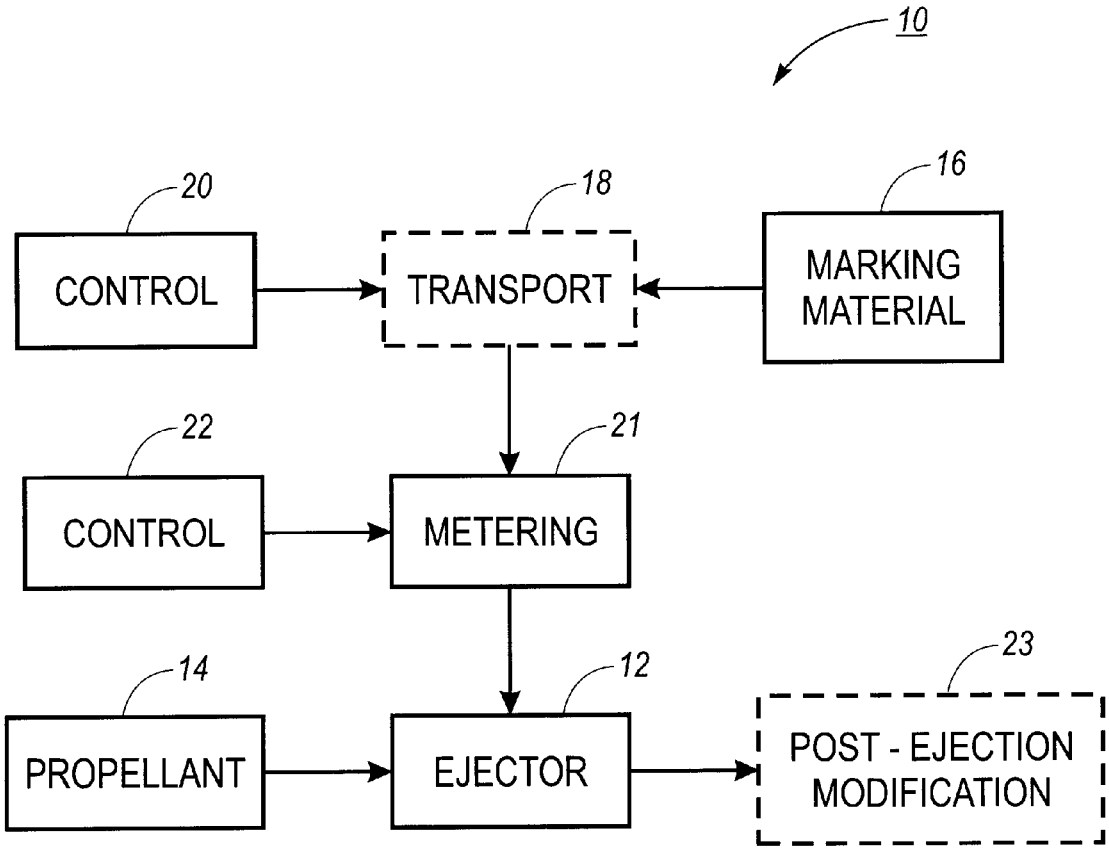
FIG. 1 is a schematic illustration of a system for marking a substrate according to the present invention.

With reference now to FIG. 1, shown therein is a schematic illustration of a ballistic aerosol marking device 10 according to one embodiment of the present invention. As shown therein, device 10 comprises one or more ejectors 12 to which a propellant 14 is fed. A marking material 16, which can be transported by a transport 18 under the command of control 20, is introduced into ejector 12. (Optional elements are indicated by dashed lines.) The marking material is metered (that is controllably introduced) into the ejector by metering device 21, under command of control 22. The marking material ejected by ejector 12 can be subject to post-ejection modification 23, optionally also part of device 10. Each of these elements will be described in further detail below. It will be appreciated that device 10 can form a part of a printer, for example of the type commonly attached to a computer network, personal computer or the like, part of a facsimile machine, part of a document duplicator, part of a labelling apparatus, or part of any other of a wide variety of marking devices.

Figure 2:
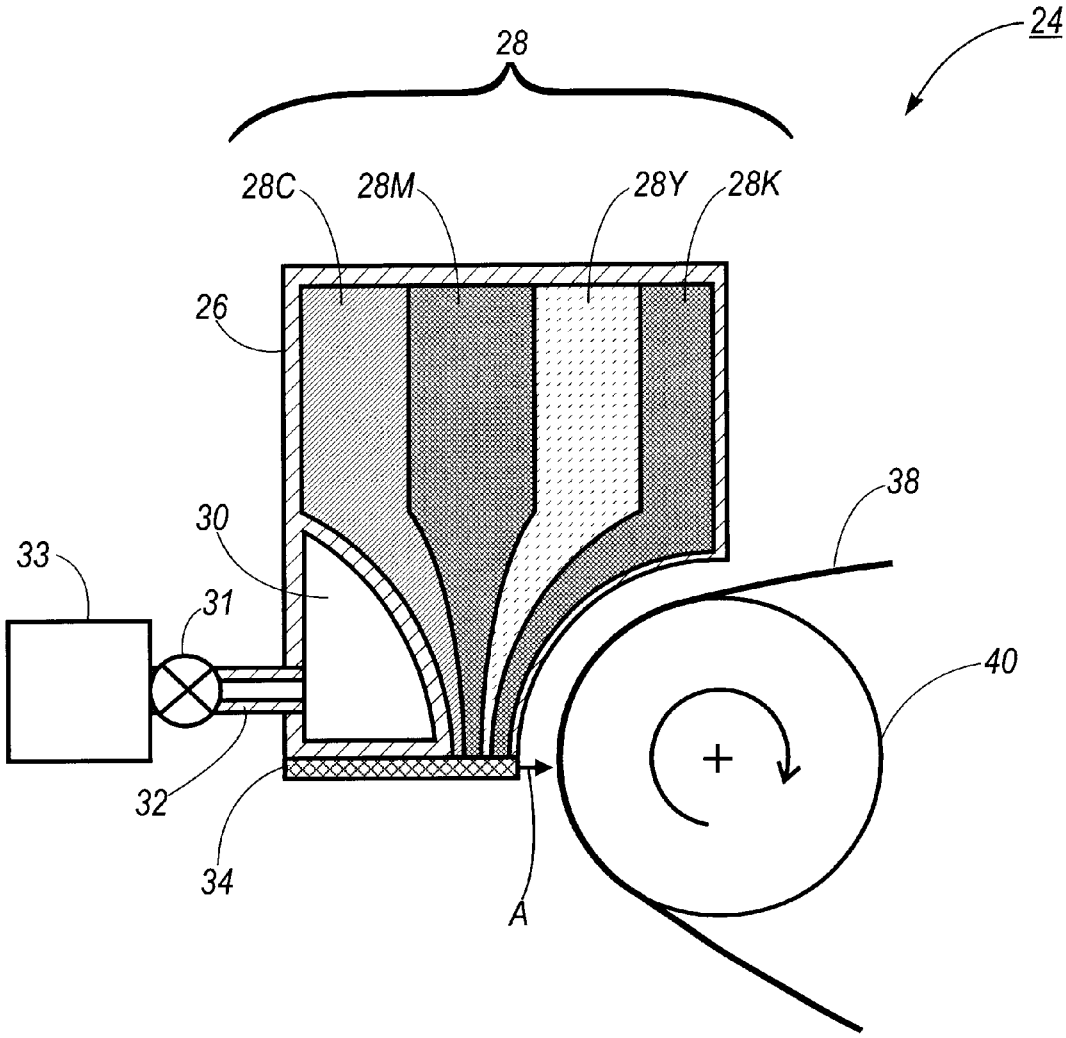
FIG. 2 is cross sectional illustration of a marking apparatus according to one embodiment of the present invention.

The embodiment illustrated in FIG. 1 can be realized by a ballistic aerosol marking device 24 of the type shown in the cut-away side view of FIG. 2. According to this embodiment, the materials to be deposited will be four colored marking materials, for example cyan (C), magenta (M), yellow (Y), and black (K), of a type described further herein, which can be deposited concomitantly, either mixed or unmixed, successively, or otherwise. While the illustration of FIG. 2 and the associated description contemplates a device for marking with four colors (either one color at a time or in mixtures thereof), a device for marking with a fewer or a greater number of colors, or other or additional materials, such as materials creating a surface for adhering marking material particles (or other substrate surface pretreatment), a desired substrate finish quality (such as a matte, satin or gloss finish or other substrate surface post-treatment), material not visible to the unaided eye (such as magnetic particles, ultra violet-fluorescent particles, and the like) or other material associated with a marked substrate, is clearly contemplated herein.

Device 24 comprises a body 26 within which is formed a plurality of cavities 28C, 28M, 28Y, and 28K (collectively referred to as cavities 28) for receiving materials to be deposited. Also formed in body 26 can be a propellant cavity 30. A fitting 32 can be provided for connecting propellant cavity 30 to a propellant source 33 such as a compressor, a propellant reservoir, or the like. Body 26 can be connected to a print head 34, comprising, among other layers, substrate 36 and channel layer 37.

Figure 3:
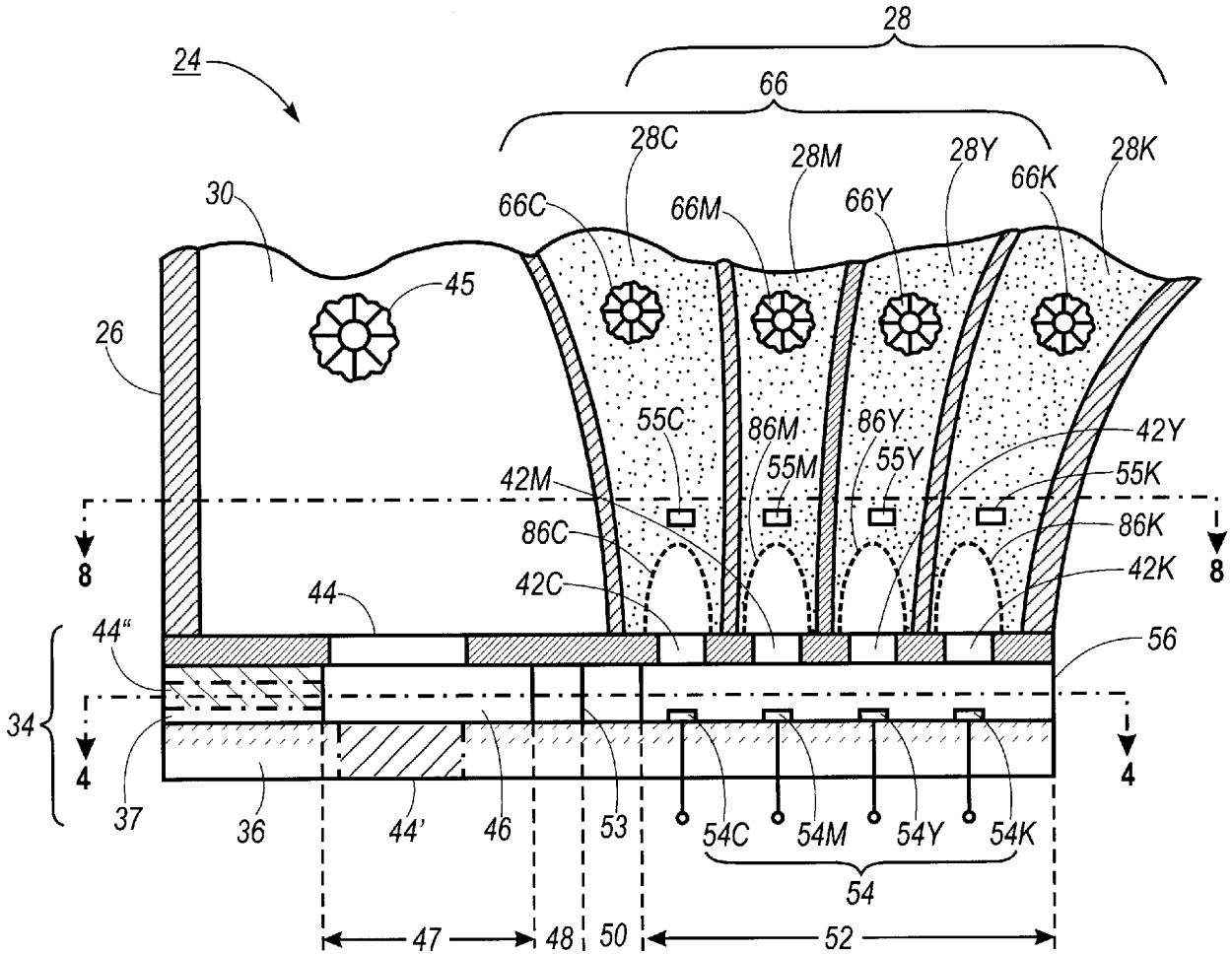
FIG. 3 is another cross sectional illustration of a marking apparatus according to one embodiment of the present invention.

With reference now to FIG. 3, shown therein is a cut-away cross section of a portion of device 24. Each of cavities 28 include a port 42C, 42M, 42Y, and 42K (collectively referred to as ports 42) respectively, of circular, oval, rectangular, or other cross-section, providing communication between said cavities, and a channel 46 which adjoins body 26. Ports 42 are shown having a longitudinal axis roughly perpendicular to the longitudinal axis of channel 46. The angle fit between the longitudinal axes of ports 42 and channel 46, however, can be other than 90 degrees, as appropriate for the particular application of the present invention.

Likewise, propellant cavity 30 includes a port 44, of circular, oval, rectangular, or other cross-section, between said cavity and channel 46 through which propellant can travel. Alternatively, print head 34 can be provided with a port 44' in substrate 36 or port 44" in channel layer 37, or combinations thereof, for the introduction of propellant into channel 46. As will be described further below, marking material is caused to flow out from cavities 28 through ports 42 and into a stream of propellant flowing through channel 46. The marking material and propellant are directed in the direction of arrow A toward a substrate 38, for example paper, supported by a platen 40, as shown in FIG. 2. It has been demonstrated that a propellant marking material flow pattern from a print head employing a number of the features described herein can remain relatively collimated for a distance of up to 10 millimeters, with an optimal printing spacing on the order of between one and several millimeters. For example, the print head can produce a marking material stream which does not deviate by more than about 20 percent, and preferably by not more than about 10 percent, from the width of the exit orifice for a distance of at least 4 times the exit orifice width. The appropriate spacing between the print head and the substrate, however, is a function of many parameters, and does not itself form a part of the present invention. In one preferred embodiment, the kinetic energy of the particles, which are moving at very high velocities toward the substrate, is converted to thermal energy upon impact of the particles on the substrate, thereby fixing or fusing the particles to the substrate. In this embodiment, the glass transition temperature of the resin in the particles is selected so that the thermal energy generated by impact with the substrate is sufficient to fuse the particles to the substrate; this process is called kinetic fusing.

According to one embodiment of the present invention, print head 34 comprises a substrate 36 and channel layer 37 in which is formed channel 46. Additional layers, such as an insulating layer, capping layer, or the like (not shown) can also form a part of print head 34. Substrate 36 is formed of a suitable material such as glass, ceramic, or the like, on which (directly or indirectly) is formed a relatively thick material, such as a thick permanent photoresist (for example, a liquid photosensitive epoxy such as SU-8, commercially available from Microlithography Chemicals, Inc.; see also U.S. Pat. No. 4,882,245, the disclosure of which is totally incorporated herein by reference) and/or a dry film-based photoresist such as the Riston photopolymer resist series, commercially available from DuPont Printed Circuit Materials, Research Triangle Park, N.C. which can be etched, machined, or otherwise in which can be formed a channel with features described below.

Figure 4:
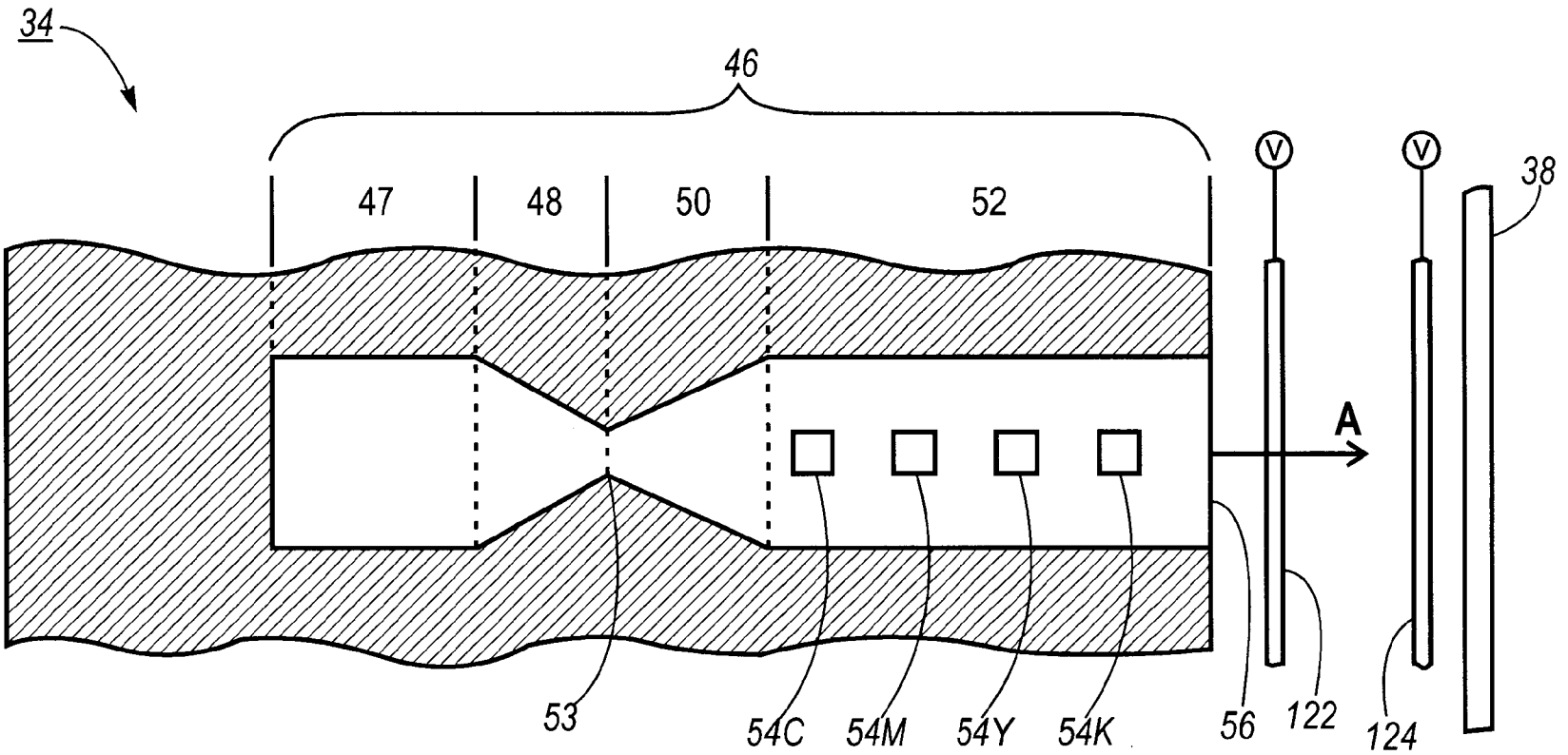
FIG. 4 is a plan view of one channel, with nozzle, of the marking apparatus shown in FIG. 3.

Referring now to FIG. 4, which is a cut-away plan view of print head 34, in one embodiment channel 46 is formed to have at a first, proximal end a propellant receiving region 47, an adjacent converging region 48, a diverging region 50, and a marking material injection region 52. The point of transition between the converging region 48 and diverging region 50 is referred to as throat 53, and the converging region 48, diverging region 50, and throat 53 are collectively referred to as a nozzle. The general shape of such a channel is sometimes referred to as a de Laval expansion pipe or a venturi convergence/divergence structure. An exit orifice 56 is located at the distal end of channel 46.

Figure 5A:
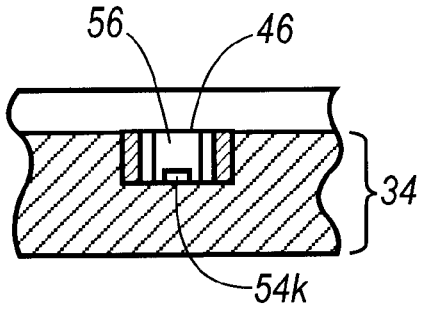
FIGS. 5A through 5C and 6A through 6C are cross sectional views, in the longitudinal direction, of several examples of channels according to the present invention.
Figure 5B:
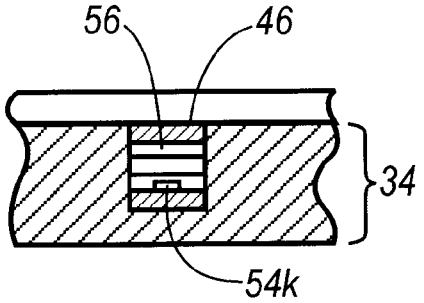
Figure 5C:
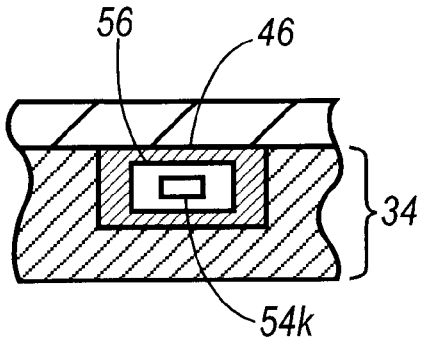
Figure 6A:
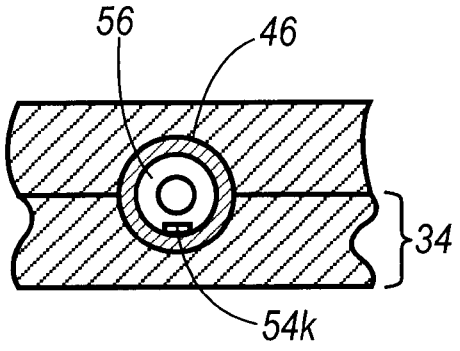
Figure 6B:
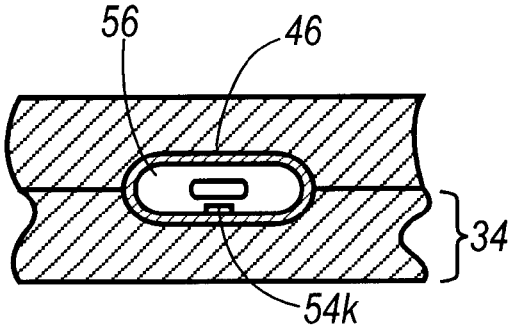
Figure 6C:
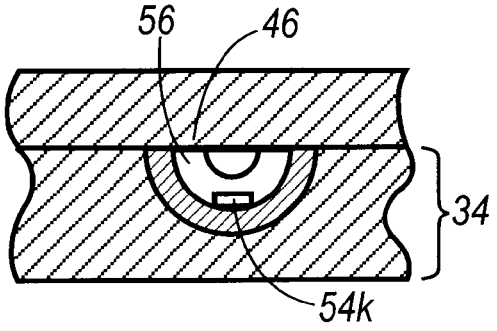

In the embodiment of the present invention shown in FIGS. 3 and 4. region 48 converges in the plane of FIG. 4, but not in the plane of FIG. 3, and likewise region 50 diverges in the plane of FIG. 4, but not in the plane of FIG. 3. Typically, this divergence determines the cross-sectional shape of the exit orifice 56. For example, the shape of orifice 56 illustrated in FIG. 5A corresponds to the device shown in FIGS. 3 and 4. However, the channel can be fabricated such that these regions converge/diverge in the plane of FIG. 3, but not in the plane of FIG. 4 (illustrated in FIG. 5B), or in both the planes of FIGS. 3 and 4 (illustrated in FIG. 5C), or in some other plane or set of planes, or in all planes (examples illustrated in FIGS. 6A–6C) as can be determined by the manufacture and application of the present invention.

Figure 7:
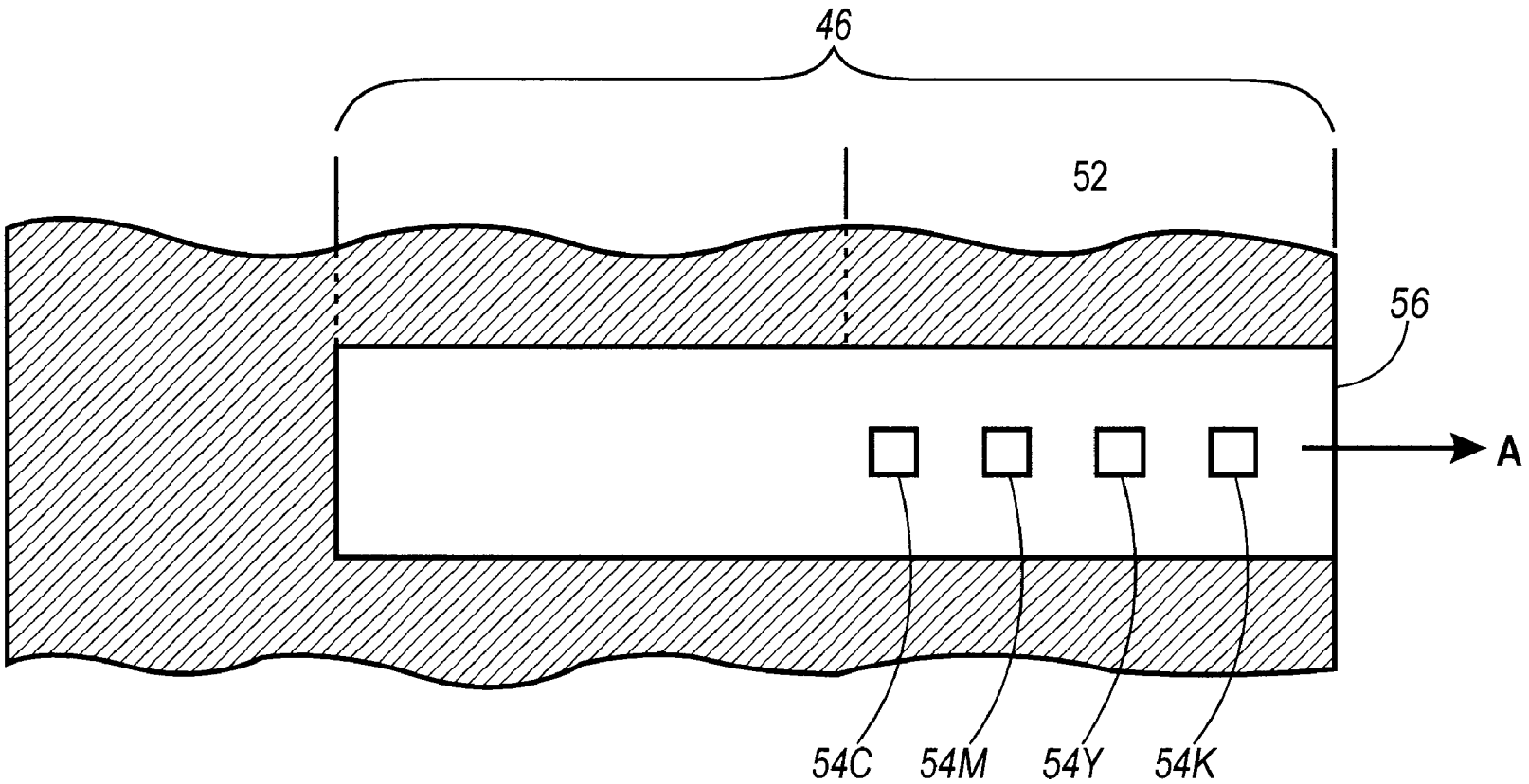
FIG. 7 is another plan view of one channel of a marking apparatus, without a nozzle, according to the present invention.
Figure 8A:
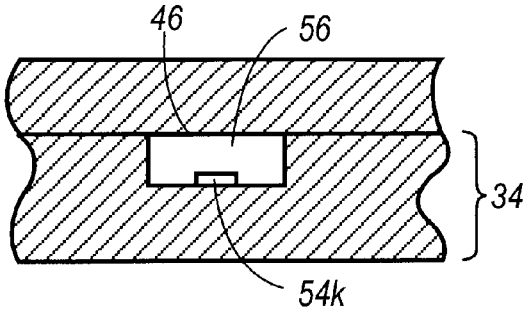
FIGS. 8A through 8D are cross sectional views, along the longitudinal axis, of several additional examples of channels according to the present invention.
Figure 8B:
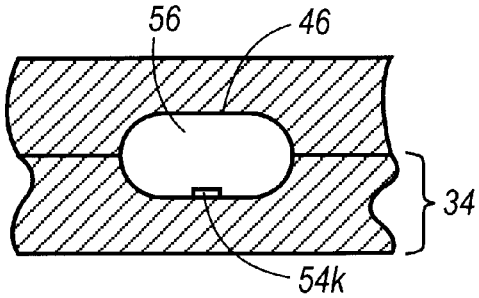
Figure 8C:
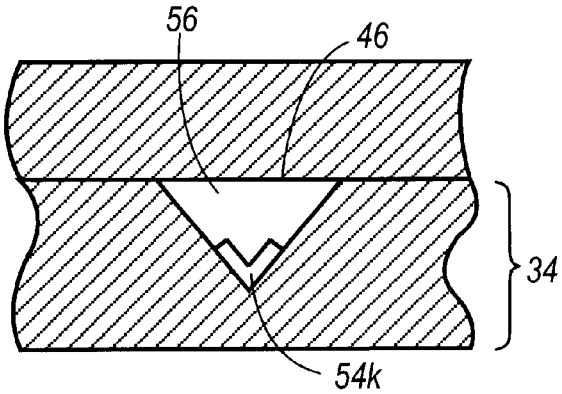
Figure 8D:
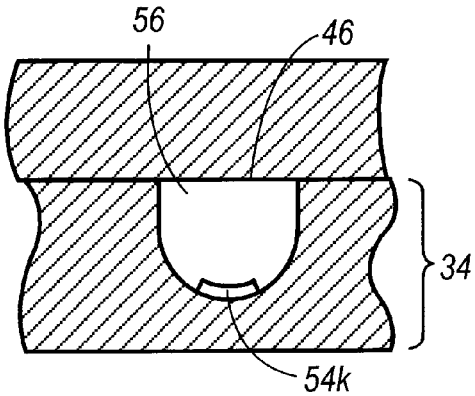

In another embodiment, shown in FIG. 7, channel 46 is not provided with a converging and diverging region, but rather has a uniform cross section along its axis. This cross section can be rectangular or square (illustrated in FIG. 8A), oval or circular (illustrated in FIG. 8B), or other cross section (examples are illustrated in FIGS. 8C–8D), as can be determined by the manufacture and application of the present invention.

Any of the aforementioned channel configurations or cross sections are suitable for the present invention. The de Laval or venturi configuration is, however, preferred because it minimizes spreading of the collimated stream of marking particles exiting the channel.

Referring again to FIG. 3, propellant enters channel 46 through port 44, from propellant cavity 30, roughly perpendicular to the long axis of channel 46. According to another embodiment, the propellant enters the channel parallel (or at some other angle) to the long axis of channel 46 by, for example, ports 44' or 44" or other manner not shown. The propellant can flow continuously through the channel while the marking apparatus is in an operative configuration (for example, a "power on" or similar state ready to mark), or can be modulated such that propellant passes through the channel only when marking material is to be ejected, as dictated by the particular application of the present invention. Such propellant modulation can be accomplished by a valve 31 interposed between the propellant source 33 and the channel 46, by modulating the generation of the propellant for example by turning on and off a compressor or selectively initiating a chemical reaction designed to generate propellant, or the like.

Marking material can controllably enter the channel through one or more ports 42 located in the marking material injection region 52. That is, during use, the amount of marking material introduced into the propellant stream can be controlled from zero to a maximum per spot. The propellant and marking material travel from the proximal end to a distal end of channel 46 at which is located exit orifice 56.

According to one embodiment for metering the marking get material, the marking material includes material which can be imparted with an electrostatic charge. For example, the marking material can comprise a pigment suspended in a binder together with UlJ charge directors. The charge directors can be charged, for example by way of a corona 66C, 66M, 66Y, and 66K (collectively referred to as 12) coronas 66), located in cavities 28, shown in FIG. 3. Another option is initially to charge the propellant gas, for example, by way of a corona 45 in cavity 30 (or some other appropriate location such as port 44 or the like.) The charged propellant can be made to enter into cavities 28 through ports 42, for the dual purposes of creating a fluidized bed 86C, 86M, 86Y, and 86K (collectively referred to as fluidized bed 86). and imparting a charge to the marking material. Other options include tribocharging, by other means external to cavities 28, or other mechanism.

Formed at one surface of channel 46, opposite each of the ports 42 are electrodes 54C, 54M, 54Y, and 54K (collectively referred to as electrodes 54). Formed within cavities 28 (or some other location such as at or within ports 44) are corresponding counter-electrodes 55C, 55M, 55Y, and 55K (collectively referred to as counter-electrodes 55). When an electric field is generated by electrodes 54 and counter-electrodes 55, the charged marking material can be attracted to the field, and exits cavities 28 through ports 42 in a direction roughly perpendicular to the propellant stream in channel 46. Alternatively, when an electric field is generated by electrodes 54 and to counter-electrodes 55, a charge can be induced on the marking material, provided that the marking material has sufficient conductivity, and can be attracted to the field, and exits cavities 28 through ports 42 in a direction roughly perpendicular to the propellant stream in channel 46. In either embodiment, the shape and location of the electrodes and the charge applied thereto determine the strength of the electric field, and accordingly determine the force of the injection of the marking material into the propellant stream. In general, the force injecting the marking material into the propellant stream is chosen such that the momentum provided by the force of the propellant stream on the marking material overcomes the injecting force, and once into the propellant stream in channel 46, the marking material travels with the propellant stream out of exit orifice 56 in a direction towards the substrate.

In the event that fusing assistance is required (for example, when an elastic substrate is used, when the marking material particle velocity is low, or the like), a number of approaches can be employed. For example, one or more heated filaments 122 con be provided proximate the ejection port 56 (shown in FIG. 4), which either reduces the kinetic energy needed to melt the marking material particle or in fact at least partly melts the marking material particle in flight. Alternatively, or in addition to filament 122, a heated filament 124 can be located proximate substrate 38 (also shown in FIG. 4) to have a similar effect.

While FIGS. 4 to 8 illustrate a print head 34 having one channel therein, it will be appreciated that a print head according to the present invention can have an arbitrary number of channels, and range from several hundred micrometers across with one or several channels, to a page-width (for example, 8.5 or more inches across) with thousands of channels. The width of each exit orifice 56 can be on the order of 250 $\mu$m or smaller, preferably in the range of 100 $\mu$m or smaller. The pitch, or spacing from edge to edge (or center to center) between adjacent exit orifices 56 can also be on the order of 250 $\mu$m or smaller, preferably in the range of 100 $\mu$m or smaller in non-staggered array. In a two-dimensionally staggered array, the pitch can be further reduced.

The marking materials of the present invention comprise toner particles typically having an average particle diameter of no more than about 10 microns, preferably no more than about 7 microns, and more preferably no more than about 6.5 microns, although the particle size can be outside of these ranges, and typically have a particle size distribution of GSD equal to no more than about 1.25, preferably no more than about 1.23, and more preferably no more than about 1.20, although the particle size distribution can be outside of these ranges. The toner particles comprise a vinyl resin, an optional colorant, and poly(3,4-ethylenedioxythiophene).

In some embodiments, the resin is selected so that the resin glass transition temperature is such as to enable kinetic fusing. If the velocity of the toner particles upon impact with the substrate is known, the value of the $T_g$ required to enable kinetic fusing can be calculated as follows:

The critical impact velocity $v_c$ required to melt the toner particle kinetically is estimated for a collision with an infinitely stiff substrate. The kinetic energy $E_k$ of a spherical particle with velocity v, density ρ, and diameter d is:

$$E_k = \frac{\pi \cdot \rho \cdot d^3 \cdot v^3}{12}$$

The energy $E_m$ required to heat a spherical particle with diameter d, heat capacity $C_p$, and density ρ form room temperature $T_0$ to beyond its glass transition temperature $T_g$ is:

$$E_m = \frac{\pi \cdot \rho \cdot d^3 \cdot C_p \cdot (T_g - T_0)}{6}$$

The energy $E_p$ required to deform a particle with diameter d and Young's modulus E beyond its elasticity limit $\sigma_e$ and into the plastic deformation regime is:

$$E_p = \frac{d^3 \cdot \sigma_e^2}{2E}$$

For kinetic fusing (melting the particle by plastic deformation from the collision with an infinitely stiff substrate), the kinetic energy of the incoming particle should be large enough to bring the particle beyond its elasticity limit. In addition, if the particle is taken beyond its elasticity limit, kinetic energy is transformed into heat through plastic deformation of the particle. If it is assumed that all kinetic energy is transformed into heat the particle will melt if the kinetic energy ($E_k$) is larger than the heat required to bring the particle beyond its glass transition temperature ($E_m$). The critical velocity for obtaining plastic deformation ($V_{cp}$) can be calculated by equating $E_k$ to $E_p$:

$$v_{cp} = \sqrt{\frac{6}{\pi \rho E}} \cdot \sigma_e$$

Note that this expression is independent of particle size. Some numerical examples (Source: CRC Handbook) include:

| Material | E (Pa) | ρ (kg/m$^3$) | $\sigma_e$(Pa) | $v_{cp}$ (m/s) |
|---|---|---|---|---|
| Steel | 200E9 | 8,000 | 700E6 | 25 |
| Polyethylene | 140E6 | 900 | 7E6 | 28 |
| Neoprene | 3E6 | 1,250 | 20E6 | 450 |
| Lead | 13E9 | 11,300 | 14E6 | 1.6 |

Most thermoplastic materials (such as polyethylene) require an impact velocity on the order of a few tens of meters per second to achieve plastic deformation from the collision with an infinitely stiff wall. Velocities on the order of several hundred of meters per second are achieved in ballistic aerosol marking processes. The critical velocity for kinetic melt ($v_{cm}$) can be calculated by equating $E_k$ to $E_m$:

$$v_{cm} = \sqrt{2 \cdot C_p \cdot (T_g - T_0)}$$

Note that this expression is independent of particle size and density. For example, for a thermoplastic material with $C_p$=1000 J/kg.K and $T_g$=60° C., $T_0$=20° C., the critical velocity $V_{cm}$ to achieve kinetic melt is equal to 280 meters per second, which is in the order of magnitude of the ballistic aerosol velocities (typically from about 300 to about 350 meters per second).

The marking materials of the present invention comprise toner particles comprising a vinyl resin and an optional colorant. The resin can be a homopolymer of one vinyl monomer or a copolymer of two or more vinyl monomers. Examples of suitable monomers include styrenes, such as styrene, p-methyl styrene, m-methyl styrene, a-methyl styrene, and the like, acrylates, such as methyl acrylate, ethyl acrylate, propyl acrylate, butyl acrylate, β-carboxyethyl acrylate, and the like, methacrylates, such as methyl methocrylate, ethyl methacrylate, propyl methacrylate, butyl methacrylate, and the like, vinyl acrylic acids, such as acrylic acid, methacrylic acid, and the like, butadiene, isoprene, styrene sulfonic acid and salts thereof (such as sodium salts or the like), 4-vinylbenzene sulfonic acid and salts thereof (such as sodium salts or the like), vinylsulfonic acid and salts thereof (such as sodium salts or the like), 2-acrylamido-N-methylpropane sulfonic acid and salts thereof (such as sodium salts or the like), vinyl-1-pyridinium propane sulfonate and salts thereof (such as sodium salts or the like), and the like. Examples of suitable resins include poly(styrene/butadiene), poly(p-methyl styrene/butadiene), poly(m-methyl styrene/butadiene), poly (α-methyl styrene/butadiene), poly(methyl methacrylate/butadiene), poly(ethyl methacrylate/butadiene), poly(propyl methacrylate/butadiene), poly(butyl methacrylate/butadiene), poly(methyl acrylate/butadiene), poly(ethyl acrylate/butadiene), poly(propyl acrylate/butadiene), poly (butyl acrylate/butadiene), poly(styrene/isoprene), poly(p-methyl styrene/isoprene), poly(m-methyl styrene/isoprene), poly(α-methyl styrene/isoprene), poly(methyl methacrylate/isoprene), poly(ethyl methacrylate/isoprene), poly(propyl methacrylate/isoprene), poly(butyl methacrylate/isoprene), poly(methyl acrylate/isoprene), poly(ethyl acrylate/isoprene), poly(propyl acrylate/isoprene), poly (butylacrylate-isoprene), poly(styrene/n-butyl acrylate/acrylic acid), poly(styrene/n-butyl methacrylate/acrylic acid), poly(styrene/n-butyl methacrylate/β-carboxyethyl acrylate), poly(styrene/n-butyl acrylate/β-carboxyethyl acrylate) poly(styrene/butadiene/methacrylic acid), poly (styrene/n-butyl acrylate/styrene sulfonate sodium salt/acrylic acid), and the like, as well as mixtures thereof.

The resin is present in the toner particles in any desired or effective amount, typically at least about 75 percent by weight of the of toner particles, and preferably at least about 85 percent by weight of the toner particles, and typically no more than about 99 percent by weight of the toner particles, and preferably no more than about 98 percent by weight of the toner particles, although the amount can be outside of these ranges. When no optional colorant is present, the amount of resin in the toner particles can also be higher than about 99 percent by weight.

Examples of suitable optional colorants include dyes and pigments, such as carbon black (for example, REGAL 330®), magnetites, phthalocyanines, HELIOGEN BLUE L6900, D6840, D7080, D7020, PYLAM OIL BLUE, PYLAM OIL YELLOW, and PIGMENT BLUE 1, all available from Paul Uhlich & Co., PIGMENT VIOLET 1, PIGMENT RED 48, LEMON CHROME YELLOW DCC 1026, E.D. TOLUIDINE RED, and BON RED C, all available from Dominion Color Co., NOVAPERM YELLOW FGL and HOSTAPERM PINK E, available from Hoechst, CINQUASIA MAGENTA, available from E.I. DuPont de Nemours & Company, 2,9-dimethyl-substituted quinacridone and anthraquinone dyes identified in the Color Index as CI 60710, CI Dispersed Red 15, diazo dyes identified in the Color Index as CI 26050, CI Solvent Red 19, copper tetra (octadecyl sulfonamido) phthalocyanine, x-copper phthalocyanine pigment listed in the Color Index as CI 74160, CI Pigment Blue, Anthrathrene Blue, identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, Permanent Yellow FGL, Pigment Yellow 74, B 15:3 cyan pigment dispersion, commercially available from Sun Chemicals, Magenta Red 81:3 pigment dispersion, commercially available from Sun Chemicals, Yellow 180 pigment dispersion, commercially available from Sun Chemicals, colored magnetites, such as mixtures of MAPICO BLACK® and cyan components, and the like, as well as mixtures thereof. Other commercial sources of pigments available as aqueous pigment dispersion from either Sun Chemical or Ciba include (but are not limited to) Pigment Yellow 17, Pigment Yellow 14, Pigment Yellow 93, Pigment Yellow 74, Pigment Violet 23. Pigment Violet 1, Pigment Green 7, Pigment Orange 36, Pigment Orange 21, Pigment Orange 16, Pigment Red 185, Pigment Red 122, Pigment Red 81:3, Pigment Blue 15:3, and Pigment Blue 61, and other pigments that enable reproduction of the maximum Pantone color space. Mixtures of colorants can also be employed. When present, the optional colorant is present in the toner particles in any desired or effective amount, typically at least about 1 percent by weight of the toner particles, and preferably at least about 2 percent by weight of the toner particles, and typically no more than about 25 percent by weight of the toner particles, and preferably no more than about 15 percent by weight of the toner particles, depending on the desired particle size, although the amount can be outside of these ranges.

The toner particles optionally can also contain charge control additives, such as alkyl pyridinium halides, including cetyl pyridinium chloride and others as disclosed in U.S. Pat. No. 4,298,672, the disclosure of which is totally incorporated herein by reference, sulfates and bisulfates, including distearyl dimethyl ammonium methyl sulfate as disclosed in U.S. Pat. No. 4,560,635, the disclosure of which is totally incorporated herein by reference, and distearyl dimethyl ammonium bisulfate as disclosed in U.S. Pat. Nos. 4,937,157, 4,560,635, and copending application Ser. No. 07/396,497, the disclosures of each of which are totally incorporated herein by reference, zinc 3,5-di-tert-butyl salicylate compounds, such as Bontron E-84, available from Orient Chemical Company of Japan, or zinc compounds as disclosed in U.S. Pat. No. 4,656,112, the disclosure of which is totally incorporated herein by reference, aluminum 3,5-di-tert-butyl salicylate compounds, such as Bontron E-88, available from Orient Chemical Company of Japan, or aluminum compounds as disclosed in U.S. Pat. No. 4,845,003, the disclosure of which is totally incorporated herein by reference, charge control additives as disclosed in U.S. Pat. Nos. 3,944,493, 4,007,293, 4,079,014, 4,394,430, 4,464,452, 4,480,021, and 4,560,635, the disclosures of each of which are totally incorporated herein by reference, and the like, as well as mixtures thereof. Charge control additives are present in the toner particles in any desired or effective amounts, typically at least about 0.1 percent by weight of the toner particles, and typically no more than about 5 percent by weight of the toner particles, although the amount can be outside of this range.

Examples of optional surface additives include metal salts, metal salts of fatty acids, colloidal silicas, and the like, as well as mixtures thereof. External additives are present in any desired or effective amount, typically at least about 0.1 percent by weight of the toner particles, and typically no more than about 2 percent by weight of the toner particles, although the amount can be outside of this range, as disclosed in, for example, U.S. Pat. Nos. 3,590,000, 3,720,617, 3,655,374 and 3,983,045, the disclosures of each of which are totally incorporated herein by reference. Preferred additives include zinc stearate and AEROSIL R812® silica, available from Degussa. The external additives can be added during the aggregation process or blended onto the formed particles.

The toner particles of the present invention are prepared by an emulsion aggregation process. This process entails (1) preparing a colorant (such as a pigment) dispersion in a solvent (such as water), which dispersion comprises a colorant, a first ionic surfactant, and an optional charge control agent; (2) shearing the colorant dispersion with a latex mixture comprising (a) a counterionic surfactant with a charge polarity of opposite sign to that of said first ionic surfactant, (b) a nonionic surfactant, and (c) a resin, thereby causing flocculation or heterocoagulation of formed particles of colorant, resin, and optional charge control agent to form electrostatically bound aggregates, and (3) heating the electrostatically bound aggregates to form stable aggregates of at least about 1 micron in average particle diameter. Toner particle size is typically at least about 1 micron and typically no more than about 7 microns, although the particle size can be outside of this range. Heating can be at a temperature typically of from about 5 to about 50° C. above the resin glass transition temperature, although the temperature can be outside of this range, to coalesce the electrostatically bound aggregates, thereby forming toner particles comprising resin, optional colorant, and optional charge control agent. Alternatively, heating can be first to a temperature below the resin glass transition temperature to form electrostatically bound micron-sized aggregates with a narrow particle size distribution, followed by heating to a temperature above the resin glass transition temperature to provide coalesced micron-sized marking toner particles comprising resin, optional colorant, and optional charge control agent. The coalesced particles differ from the uncoalesced aggregates primarily in morphology; the uncoalesced particles have greater surface area, typically having a "grape cluster" shape, whereas the coalesced particles are reduced in surface area, typically having a "potato" shape or even a spherical shape. The particle morphology can be controlled by adjusting conditions during the coalescence process, such as pH, temperature, coalescence time, and the like. Optionally, an additional amount of an ionic surfactani (of the same polarity as that of the initial latex) or nonionic surfactant can be added to the mixture prior to heating to minimize subsequent further growth or enlargement of the particles, followed by heating and coalescing the mixture. Subsequently, the toner particles are washed extensively to remove excess water soluble surfactant or surface absorbed surfactant, and are then dried to produce (optionally colored) polymeric toner particles. An alternative process entails using a flocculating or coagulating agent such as poly(aluminum chloride) instead of a counterionic surfactant of opposite polarity to the ionic surfactant in the latex formation; in this process, the growth of the aggregates can be slowed or halted by adjusting the solution to a more basic pH (typically at least about 7 or 8, although the pH can be outside of this range), and, during the coalescence step, the solution can, if desired, be adjusted to a more acidic pH to adjust the particle morphology. The coagulating agent typically is added in an acidic solution (for example, a 1 molar nitric acid solution) to the mixture of ionic latex and dispersed optional colorant, and during this addition step the viscosity of the mixture increases. Thereafter, heat and stirring are applied to induce aggregation and formation of micron-sized particles. When the desired particle size is achieved, this size can be frozen by increasing the pH of the mixture, typically to from about 7 to about 8, although the pH can be outside of this range. Thereafter, the temperature of the mixture can be increased to the desired coalescence temperature, typically from about 80 to about 96° C., although the temperature can be outside of this range. Subsequently, the particle morphology can be adjusted by dropping the pH of the mixture, typically to values of from about 3.5 to about 7, although the pH can be outside of this range.

When particles are prepared without a colorant, the latex (usually around 40 percent solids) is diluted to the right solids loading (of around 12 to 15 percent by weight solids) and then under identical shearing conditions the counterionic surfactant or polyaluminum chloride is added until flocculation or heterocoagulation takes place.

Examples of suitable ionic surfactants include anionic surfactants, such as sodium dodecylsulfate, sodium dodecylbenzene sulfonate, sodium dodecyinaphthalenesulfate, dialkyl benzenealkyl sulfates and sulfonates, abitic acid, NEOGEN R® and NEOGEN SC® available from Kao, DOWFAX®, available from Dow Chemical Co., and the like, as well as mixtures thereof. Anionic surfactants can be employed in any desired or effective amount, typically at least about 0.01 percent by weight of monomers used to prepare the copolymer resin, and preferably at least about 0.1 percent by weight of monomers used to prepare the copolymer resin, and typically no more than about 10 percent by weight of monomers used to prepare the copolymer resin, and preferably no more than about 5 percent by weight of monomers used to prepare the copolymer resin, although the amount can be outside of these ranges.

Examples of suitable ionic surfactants also include cationic surfactants, such as dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, and $C_{17}$ trimethyl ammonium bromides, halide salts of quaternized polyoxyethylalkylamines, dodecylbenzyl triethyl ammonium chloride, MIRAPOL® and ALKAQUAT® (available from Alkaril Chemical Company), SANIZOL® (benzalkonium chloride, available from Kao Chemicals), and the like, as well as mixtures thereof. Cationic surfactants can be employed in any desired or effective amounts, typically at least about 0.1 percent by weight of water, and typically no more than about 5 percent by weight of water, although the amount can be outside of this range. Preferably the molar ratio of the cationic surfactant used for flocculation to the anionic surfactant used in latex preparation from about 0.5:1 to about 4:1, and preferably from about 0.5:1 to about 2:1, although the relative amounts can be outside of these ranges.

Examples of suitable nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol (available from Rhone-Poulenc as IGEPAL CA-210®, IGEPAL CA-520®, IGEPAL CA-720®, IGEPAL CO-890®, IGEPAL CO-720®, IGEPAL CO-290®, IGEPAL CA-210®, ANTAROX 890® and ANTAROX 897®), and the like, as well as mixtures thereof. The nonionic surfactant can be present in any desired or effective amount, typically at least about 0.01 percent by weight of monomers used to prepare the copolymer resin, and preferably at least about 0.1 percent by weight of monomers used to prepare the copolymer resin, and typically no more than about 10 percent by weight of monomers used to prepare the copolymer resin, and preferably no more than about 5 percent by weight of monomers used to prepare the copolymer resin, although the amount con be outside of these ranges.

When a sulfonated monomer is to be included in the vinyl resin, several methods can be used to prepare the vinyl polymer. For example, since the sulfonated monomers are generally water soluble, in a batch emulsion polymerization process the sulfonated monomer can be added into the reactor with all of the other reactants at the beginning of the reaction. The reaction mixture is homogenized with some of the surfactant solution to produce a stable emulsified oil (containing the monomer) in water solution. Another method entails semicontinuous emulsion polymerization. In a specific embodiment of this method, a starve-fed semicontinuous process is used wherein the rate of monomer addition is equal to or less than the rate of monomer polymerization; this method enables better control over the composition of the polymer chains. To achieve the same polymer composition throughout the semicontinuous process, the monomer feed composition is kept constant. Yet another method is to add the sulfonated monomer into the aqueous initiator solution. This solution is fed into the reactor after the initial monomer seed solution is fed in. After a period of time, the remaining larger portion of emulsified monomer is fed in over a period of about 1 hour at a controlled rate and then continued to heat until polymerization is complete. Still another method is to add the sulfonated monomer in with the initial surfactant charge in the reactor prior to the addition of any monomer. Another method is to add the dissolved sulfonated monomer after all of the other monomers were added as a separate phase.

The emulsion aggregation process suitable for making the toner materials for the present invention has been disclosed in previous U.S. patents. For example, U.S. Pat. No. 5,290,654 (Sacripante et al.), the disclosure of which is totally incorporated herein by reference, discloses a process for the preparation of toner compositions which comprises dissolving a polymer, and, optionally a pigment, in an organic solvent; dispersing the resulting solution in an aqueous medium containing a surfactant or mixture of surfactants; stirring the mixture with optional heating to remove the organic solvent, thereby obtaining suspended particles of about 0.05 micron to about 2 microns in volume diameter; subsequently homogenizing the resulting suspension with an optional pigment in water and surfactant; followed by aggregating the mixture by heating, thereby providing toner particles with an average particle volume diameter of from between about 3 to about 21 microns when said pigment is present.

U.S. Pat. No. 5,278,020 (Grushkin et al.), the disclosure of which is totally incorporated herein by reference, discloses a toner composition and processes for the preparation thereof comprising the steps of: (i) preparing a latex emulsion by agitating in water a mixture of a nonionic surfactant, an anionic surfactant, a first nonpolar olefinic monomer, a second nonpolar diolefinic monomer, a free radical initiator, and a chain transfer agent; (ii) polymerizing the latex emulsion mixture by heating from ambient temperature to about 80° C. to form nonpolar olefinic emulsion resin particles of volume average diameter from about 5 nanometers to about 500 nanometers; (iii) diluting the nonpolar olefinic emulsion resin particle mixture with water; (iv) adding to the diluted resin particle mixture a colorant or pigment particles and optionally dispersing the resulting mixture with a homogenizer; (v) adding a cationic surfactant to flocculate the colorant or pigment particles to the surface of the emulsion resin particles; (vi) homogenizing the flocculated mixture at high shear to form statically bound aggregated composite particles with a volume average diameter of less than or equal to about 5 microns; (vii) heating the statically bound aggregate composite particles to form nonpolar toner sized particles; (viii) optionally halogenating the nonpolar toner sized particles to form nonpolar toner sized particles having a halopolymer resin outer surface or encapsulating shell; and (ix) isolating the nonpolar toner sized composite particles.

U.S. Pat. No. 5,308,734 (Sacripante et al.), the disclosure of which is totally incorporated herein by reference, discloses a process for the preparation of toner compositions which comprises generating an aqueous dispersion of toner fines, ionic surfactant and nonionic surfactant, adding thereto a counterionic surfactant with a polarity opposite to that of said ionic surfactant, homogenizing and stirring said mixture, and heating to provide for coalescence of said toner fine particles.

U.S. Pat. No. 5,346,797 (Kmiecik-Lawrynowicz et al.), the disclosure of which is totally incorporated herein by reference, discloses a process for the preparation of toner compositions comprising (i) preparing a pigment dispersion in a solvent, which dispersion comprises a pigment, an ionic surfactant, and optionally a charge control agent; (ii) shearing the pigment dispersion with a latex mixture comprising a counterionic surfactant with a charge polarity of opposite sign to that of said ionic surfactant, a nonionic surfactant, and resin particles, thereby causing a flocculation or heterocoagulation of the formed particles of pigment, resin, and charge control agent to form electrostatically bound toner size aggregates; and (iii) heating the statically bound aggregated particles to form said toner composition comprising polymeric resin, pigment and optionally a charge control agent.

U.S. Pat. No. 5,344,738 (Kmiecik-Lawrynowicz et al.), the disclosure of which is totally incorporated herein by reference, discloses a process for the preparation of toner compositions with a volume median particle size of from about 1 to about 25 microns, which process comprises: (i) preparing by emulsion polymerization an anionic charged polymeric latex of submicron particle size, and comprising resin particles and anionic surfactant; (ii) preparing a dispersion in water, which dispersion comprises optional pigment, an effective amount of cationic flocculent surfactant, and optionally a charge control agent; (iii) shearing the dispersion (ii) with the polymeric latex, thereby causing a flocculation or heterocoagulation of the formed particles of optional pigment, resin, and charge control agent to form a high viscosity gel in which solid particles are uniformly dispersed; (iv) stirring the above gel comprising latex particles and oppositely charged dispersion particles for an effective period of time to form electrostatically bound relatively stable toner size aggregates with narrow particle size distribution; and (v) heating the electrostatically bound aggregated particles at a temperature above the resin glass transition temperature, thereby providing the toner composition comprising resin, optional pigment, and optional charge control agent.

U.S. Pat. No. 5,364,729 (Kmiecik-Lawrynowicz et al.), the disclosure of which is totally incorporated herein by reference, discloses a process for the preparation of toner compositions comprising: (i) preparing a pigment dispersion, which dispersion comprises a pigment, an ionic surfactant, and optionally a charge control agent; (ii) shearing said pigment dispersion with a latex or emulsion blend comprising resin, a counterionic surfactant with a charge polarity of opposite sign to that of said ionic surfactant, and a nonionic surfactant; (iii) heating the above sheared blend below about the glass transition temperature (Tg) of the resin, to form electrostatically bound toner size aggregates with a narrow particle size distribution; and (iv) heating said bound aggregates above about the Tg of the resin.

U.S. Pat. No. 5,370,963 (Patel et al.), the disclosure of which is totally incorporated herein by reference, discloses a process for the preparation of toner compositions with controlled particle size comprising: (i) preparing a pigment dispersion in water, which dispersion comprises pigment, an ionic surfactant, and an optional charge control agent; (ii) shearing at high speeds the pigment dispersion with a polymeric latex comprising resin, a counterionic surfactant with a charge polarity of opposite sign to that of said ionic surfactant, and a nonionic surfactant, thereby forming a uniform homogeneous blend dispersion comprising resin, pigment, and optional charge agent; (iii) heating the above sheared homogeneous blend below about the glass transition temperature (Tg) of the resin while continuously stirring to form electrostatically bounded toner size aggregates with a narrow particle size distribution; (iv) heating the statically bound aggregated particles above about the Tg of the resin particles to provide coalesced toner comprising resin, pigment, and optional charge control agent, and subsequently optionally accomplishing (v) and (vi); (v) separating said toner; and (vi) drying said toner.

U.S. Pat. No. 5,403,693 (Patel et al.), the disclosure of which is totally incorporated herein by reference, discloses a process for the preparation of toner compositions with controlled particle size comprising: (i) preparing a pigment dispersion in water, which dispersion comprises a pigment, an ionic surfactant in amounts of from about 0.5 to about 10 percent by weight of water, and an optional charge control agent; (ii) shearing the pigment dispersion with a latex mixture comprising a counterionic surfactant with a charge polarity of opposite sign to that of said ionic surfactant, a nonionic surfactant, and resin particles, thereby causing a flocculation or heterocoagulation of the formed particles of pigment, resin, and charge control agent; (iii) stirring the resulting sheared viscous mixture of (ii) at from about 300 to about 1,000 revolutions per minute to form electrostatically bound substantially stable toner size aggregates with a narrow particle size distribution; (iv) reducing the stirring speed in (iii) to from about 100 to about 600 revolutions per minute, and subsequently adding further anionic or nonionic surfactant in the range of from about 0.1 to about 10 percent by weight of water to control, prevent, or minimize further growth or enlargement of the particles in the coalescence step (iii); and (v) heating and coalescing from about 5 to about 50° C. above about the resin glass transition temperature, Tg, which resin Tg is from between about 45° C. to about 90° C. and preferably from between about 50° C. and about 80° C. the statically bound aggregated particles to form said toner composition comprising resin, pigment, and optional charge control agent.

U.S. Pat. No. 5,418,108 (Kmiecik-Lawrynowicz et al.), the disclosure of which is totally incorporated herein by reference, discloses a process for the preparation of toner compositions with controlled particle size and selected morphology comprising (i) preparing a pigment dispersion in water, which dispersion comprises pigment, ionic surfactant, and optionally a charge control agent; (ii) shearing the pigment dispersion with a polymeric latex comprising resin of submicron size, a counterionic surfactant with a charge polarity of opposite sign to that of said ionic surfactant, and a nonionic surfactant, thereby causing a flocculation or heterocoagulation of the formed particles of pigment, resin, and charge control agent, and generating a uniform blend dispersion of solids of resin, pigment, and optional charge control agent in the water and surfactants; (iii) (a) continuously stirring and heating the above sheared blend to form electrostatically bound toner size aggregates; or (iii) (b) further shearing the above blend to form electrostatically bound well packed aggregates; or (iii) (c) continuously shearing the above blend, while heating to form aggregated flake-like particles; (iv) heating the above formed aggregated particles about above the Tg of the resin to provide coalesced particles of toner; and optionally (v) separating said toner particles from water and surfactants; and (vi) drying said toner particles.

U.S. Pat. No. 5,405,728 (Hopper et al.), the disclosure of which is totally incorporated herein by reference, discloses a process for the preparation of toner compositions comprising (i) preparing a pigment dispersion in water, which dispersion comprises a pigment, an ionic surfactant, and optionally a charge control agent; (ii) shearing the pigment dispersion with a latex containing a controlled solid contents of from about 50 weight percent to about 20 percent of polymer or resin, counterionic surfactant, and nonionic surfactant in water, counterionic surfactant with a charge polarity of opposite sign to that of said ionic surfactant, thereby causing a flocculation or heterocoagulation of the formed particles of pigment, resin, and charge control agent to form a dispersion of solids of from about 30 weight percent to 2 percent comprising resin, pigment, and optionally charge control agent in the mixture of nonionic, anionic, and cationic surfactants; (iii) heating the above sheared blend at a temperature of from about 5° to about 25° C. about below the glass transition temperature (Tg) of the resin while continuously stirring to form toner sized aggregates with a narrow size dispersity; and (iv) heating the electrostatically bound aggregated particles at a temperature of from about 5° to about 50° C. about above the (Tg) of the resin to provide a toner composition comprising resin, pigment, and optionally a charge control agent.

U.S. Pat. No. 5,869,215 (Ong et al.), the disclosure of which is totally incorporated herein by reference, discloses a process for the to preparation of toner including (i) blending an aqueous colorant dispersion with a latex blend comprising a linear polymer and a soft crosslinked polymer; (ii) heating the resulting mixture at about below, or about equal to the glass transition temperature (Tg) of the linear latex polymer to form aggregates; and (iii) subsequently heating said aggregate suspension about above, or about equal to the Tg of the linear latex polymer to effect fusion or coalescence of said aggregates.

U.S. Pat. No. 5,869,216 (Ong et al.), the disclosure of which is totally incorporated herein by reference, discloses a process for the preparation of toner comprising blending an aqueous colorant dispersion and a latex emulsion containing resin; heating the resulting mixture at a temperature below about the glass transition temperature (Tg) of the latex resin to form toner sized aggregates; heating said resulting aggregates at a temperature above about the Tg of the latex resin to effect fusion or coalescence of the aggregates; redispersing said toner in water at a pH of above about 7; contacting the resulting mixture with a metal halide or salt, and then with a mixture of an alkaline base and a solicylic acid, a catechol, or mixtures thereof at a temperature of from about 25° C. to about 80° C.; and optionally isolating the toner product, washing, and drying.

U.S. Pat. No. 5,910,387 (Mychajlowskij et al.), the disclosure of which is totally incorporated herein by reference, discloses a toner composition comprising colorant, and an addition polymer resin of styrene, butadiene, acrylonitrile and acrylic acid.

U.S. Pat. No. 5,919,595 (Mychajlowskij et al.), the disclosure of which is totally incorporated herein by reference, discloses a process for the preparation of toner comprising mixing an emulsion latex, a colorant dispersion, and monocationic salt, and which mixture possesses an ionic strength of from about 0.001 molar (M) to about 5 molar, and optionally cooling.

U.S. Pat. No. 5,922,501 (Cheng et al.), the disclosure of which is totally incorporated herein by reference, discloses a process for the preparation of toner comprising blending an aqueous colorant dispersion and a latex resin emulsion, and which latex resin is generated from a dimeric acrylic acid, an oligomer acrylic acid, or mixtures thereof and a monomer; heating the resulting mixture at a temperature about equal, or below about the glass transition temperature (Tg) of the latex resin to form aggregates; heating the resulting aggregates at a temperature about equal to, or above about the Tg of the latex resin to effect coalescence and fusing of the aggregates; and optionally isolating the toner product, washing, and drying.

U.S. Pat. No. 5,945,245 (Mychajlowskij et al.), the disclosure of which is totally incorporated herein by reference, discloses a surfactant free process for the preparation of toner comprising heating a mixture of an emulsion latex, a colorant, and an organic complexing agent.

U.S. Pat. No. 5,366,841 (Patel et al.). the disclosure of which is totally incorporated herein by reference, discloses a process for the preparation of toner compositions comprising: (i) preparing a pigment dispersion in water, which dispersion comprises a pigment, an ionic surfactant, and optionally a charge control agent; (ii) shearing the pigment dispersion with a latex blend comprising resin particles, a counterionic surfactant with a charge polarity of opposite sign to that of said ionic surfactant, and a nonionic surfactant, thereby causing a flocculation or heterocoagulation of the formed particles of pigment, resin, and charge control agent to form a uniform dispersion of solids in the water, and surfactant; (iii) heating the above sheared blend at a critical temperature region about equal to or above the glass transition temperature (Tg) of the resin, while continuously stirring, to form electrostatically bounded toner size aggregates with a narrow particle size distribution and wherein said critical temperature is from about 0° C. to about 10° C. above the resin Tg, and wherein the resin Tg is from about 30° C. to about 65° C. and preferably in the range of from about 45° C. to about 65° C.; (iv) heating the statically bound aggregated particles from about 10° C. to about 45° C. above the Tg of the resin particles to provide a toner composition comprising polymeric resin, pigment, and optionally a charge control agent; and (v) optionally separating and drying said toner.

U.S. Pat. No. 5,501,935 (Patel et al.), the disclosure of which is totally incorporated herein by reference, discloses a process for the preparation of toner compositions consisting essentially of (i) preparing a pigment dispersion, which dispersion comprises a pigment, an ionic surfactant, and optionally a charge control agent; (ii) shearing said pigment dispersion with a latex or emulsion blend comprising resin, a counterionic surfactant with a charge polarity of opposite sign to that of said ionic surfactant, and a nonionic surfactant; (iii) heating the above sheared blend below about the glass transition temperature (Tg) of the resin to form electrostatically bound toner size aggregates with a narrow particle size distribution; (iv) subsequently adding further anionic or nonionic surfactant solution to minimize further growth in the coalescence (v); and (v) heating said bound aggregates above about the Tg of the resin and wherein said heating is from a temperature of about 103° to about 120° C., and wherein said toner compositions are spherical in shape.

U.S. Pat. No. 5,496,676 (Croucher et al.), the disclosure of which is totally incorporated herein by reference, discloses a process comprising: (i) preparing a pigment dispersion comprising pigment, ionic surfactant, and optional charge control agent; (ii) mixing at least two resins in the form of latexes, each latex comprising a resin, ionic and nonionic surfactants, and optionally a charge control agent, and wherein the ionic surfactant has a countercharge to the ionic surfactant of (i) to obtain a latex blend; (iii) shearing said pigment dispersion with the latex blend of (ii) comprising resins, counterionic surfactant with a charge polarity of opposite sign to that of said ionic surfactant, and a nonionic surfactant; (iv) heating the above sheared blends of (iii) below about the gloss transition temperature (Tg) of the resin, to form electrostatically bound toner size aggregates with a narrow particle size distribution; and (v) subsequently adding further anionic surfactant solution to minimize further growth of the bound aggregates (vi); (vi) heating said bound aggregates above about the glass transition temperature Tg of the resin to form stable toner particles; and optionally (vii) separating and drying the toner.

U.S. Pat. No. 5,527,658 (Hopper et al.), the disclosure of which is totally incorporated herein by reference, discloses a process for the preparation of toner comprising: (i) preparing a pigment dispersion comprising pigment, an ionic surfactant, and optionally a charge control agent; (ii) shearing said pigment dispersion with a latex comprising resin, a counterionic surfactant with a charge polarity of opposite sign to that of said ionic surfactant, and a nonionic surfactant; (iii) heating the above sheared blend of (ii) about below the glass transition temperature (Tg) of the resin, to form electrostatically bound toner size aggregates with a volume average diameter of from between about 2 and about 15 microns and with a narrow particle size distribution as reflected in the particle diameter GSD of between about 1.15 and about 1.30, followed by the addition of a water insoluble transition metal containing powder ionic surfactant in an amount of from between about 0.05 and about 5 weight percent based on the weight of the aggregates; and (iv) heating said bound aggregates about above the Tg of the resin to form toner.

U.S. Pat. No. 5,585,215 (Ong et al.), the disclosure of which is totally incorporated herein by reference, discloses a toner comprising color pigment and an addition polymer resin, wherein said resin is generated by emulsion polymerization of from 70 to 85 weight percent of styrene, from about 5 to about 20 weight percent of isoprene, from about 1 to about 15 weight percent of acrylate, or from about 1 to about 15 weight percent of methacrylate, and from about 0.5 to about 5 weight percent of acrylic acid.

U.S. Pat. No. 5,650,255 (Ng et al.), the disclosure of which is totally incorporated herein by reference, discloses an in situ chemical process for the preparation of toner comprising (i) the provision of a latex, which latex comprises polymeric resin particles, an ionic surfactant, and a nonionic surfactant; (ii) providing a pigment dispersion, which dispersion comprises a pigment solution, a counterionic surfactant with a charge polarity of opposite sign to that of said ionic surfactant, and optionally a charge control agent; (iii) mixing said pigment dispersion with said latex with a stirrer equipped with an impeller, stirring at speeds of from about 100 to about 900 rpm for a period of from about 10 minutes to about 150 minutes; (iv) heating the above resulting blend of latex and pigment mixture to a temperature below about the glass transition temperature (Tg) of the resin to form electrostatically bound toner size aggregates; (v) adding further aqueous ionic surfactant or stabilizer in the range amount of from about 0.1 percent to 5 percent by weight of reactants to stabilize the above electrostatically bound toner size aggregates; (vi) heating said electrostatically bound toner sized aggregates above about the Tg of the resin to form toner size particles containing pigment, resin and optionally a charge control agent; (vii) optionally isolating said toner, optionally washing with water; and optionally (viii) drying said toner.

U.S. Pat. No. 5,650,256 (Veregin et al.), the disclosure of which is totally incorporated herein by reference, discloses a process for the preparation of toner comprising: (i) preparing a pigment dispersion, which dispersion comprises a pigment and an ionic surfactant; (ii) shearing said pigment dispersion with a latex or emulsion blend comprising resin, a counterionic surfactant with a charge polarity of opposite sign to that of said ionic surfactant, and a nonionic surfactant, and wherein said resin contains an acid functionality; (iii) heating the above sheared blend below about the glass transition temperature (Tg) of the resin to form electrostatically bound toner size aggregates; (iv) adding anionic surfactant to stabilize the aggregates obtained in (iii); (v) coalescing said aggregates by heating said bound aggregates above about the Tg of the resin; (vi) reacting said resin of (v) with acid functionality with a base to form an acrylic acid salt, and which salt is ion exchanged in water with a base or a salt, optionally in the presence of metal oxide particles, to control the toner triboelectrical charge, which toner comprises resin and pigment; and (vii) optionally drying the toner obtained.

U.S. Pat. No. 5,376,172 (Tripp et al.), the disclosure of which is totally incorporated herein by reference, discloses a process for preparing silane metal oxides comprising reacting a metal oxide with an amine compound to form an amine metal oxide intermediate, and subsequently reacting said intermediate with a halosilane. Also disclosed are toner compositions for electrostatic imaging processes containing the silane metal oxides thus prepared as charge enhancing additives.

Copending U.S. application Ser. No. 09/173,405, filed Oct. 15, 1998, entitled "Toner Coagulant Processes," with the named inventors Raj D. Patel, Michael A. Hopper, and Richard P. Veregin, the disclosure of which is totally incorporated herein by reference, discloses a process for the preparation of toner which comprises mixing a colorant, a latex, and two coagulants, followed by aggregation and coalescence. In one embodiment, the first coagulant is a polyaluminum hydroxy halide and the second coagulant is a cationic surfactant.

In a particularly preferred embodiment of the present invention (with example amounts provided to indicate relative ratios of materials), the emulsion aggregation process entails diluting with water (646.1 grams) an aqueous pigment dispersion solution (14.6 grams) containing 51.4 percent by weight solids of Pigment (Blue Cyan 15:3) dispersed into an anionic surfactant solution and stirred at low shear of 400 revolutions per minute using a homogenizer. Slowly 249.4 grams of an emulsion latex (40.00 percent by weight solids; prepared by emulsion polymerization of styrene, n-butyl acrylate, and acrylic acid monomers initiated with ammonium persulfate and stabilized with Neogen R and Antaraox CA-897 surfactants) is added. The ratio of monomers is about 82 percent by weight styrene and about 18 percent by weight n-butyl acrylate. For every 100 parts by weight of monomer, 2 parts by weight of acrylic acid is added to the monomer mixture. To this well stirred (4,000 to 5,000 revolutions per minute) pigmented latex dispersion is added an acidic solution consisting of 1 molar nitric acid (7.5 grams) and 3.2 grams of the flocculent poly(aluminum chloride), and as the acidic flocculent solution is added the solution viscosity generally increases. The mixture is transferred into a 2 liter glass reaction kettle equipped with an overhead stirrer, temperature probe, and water-jacketed heating mantle to control the reaction temperature. The particles are heated at about 1° C. per minute up to about 50° C. to produce the particle size of approximately 0.5 microns smaller than desired. At this point the shell latex which is approximately 25 to 30 weight percent of the total latex, and of identical composition to the latex already used is added (106.98 grams). The aggregation is continued until the desired particle size and size distribution is reached. try The particle size and size distribution are then frozen by adjusting the reaction pH to 7.5 with 4 percent sodium hydroxide solution. The reactor temperature is increased to about 95° C. for coalescence, and the pH is dropped to about 4.0 by adding 1 molar nitric acid solution. particles are then coalesced by heating at 95° C. for approximately 3 hours. After cooling, the particle suspension is washed with deionized in water and filtered through a 1.2 micron porous filter paper. The filtered particles are re-suspended in water for approximately 0.5 to 1 hour and then filtered again through the 1.2 micron porous filter paper. This washing step is repeated 4 to 5 times. The particles are now ready for the conductive polymer surface treatment.

When particles without colorant are desired, the emulsion aggregation process entails diluting with water (761.43 grams) 375 grams of an emulsion latex (40.00 percent by weight solids; prepared by emulsion polymerization of styrene, n-butyl acrylate, and acrylic acid monomers initiated with ammonium persulfate and stabilized with Neogen R and Antaraox CA-897 surfactants). The ratio of monomers is about 82 percent by weight styrene and about 18 percent by weight n-butyl acrylate. For every 100 parts by weight of monomer, 2 parts by weight of acrylic acid is added to the monomer mixture. To this well stirred (4,000 to 5,000 revolutions per minute) latex dispersion is added an acidic solution consisting of 1 molar nitric acid (7.86 grams) and 3.35 grams of the flocculant poly(aluminum chloride), and as the acidic flocculant solution is added the solution viscosity generally increases. The mixture is transferred into a 2 liter glass reaction kettle equipped with an overhead stirrer, temperature probe, and water-jacketed heating mantle to control the reaction temperature. The particles are heated at about 1° C. per minute up to about 50° C. to produce the desired particle size and size distribution. The particle size and size distribution are then frozen by adjusting the reaction pH to 7.5 with 4 percent sodium hydroxide solution. The reactor temperature is increased to about 95° C. for coalescence, and the pH is dropped to about 4.0 by adding 1 molar nitric acid solution. The particles are then coalesced by heating at 95° C. for approximately 3 hours. After cooling, the particle suspension is washed with deionized water and filtered through a 1.2 micron porous filter paper. The filtered particles are re-suspended in water for approximately 0.5 to 1 hour and then filtered again through the 1.2 micron porous filter paper. This washing step is repeated 4 to 5 times. The particles are now ready for the conductive polymer surface treatment.

Subsequent to synthesis of the toner particles, the toner particles are washed, preferably with water. Thereafter, a poly(3,4-ethylenedioxythiophene), which, in its reduced form is of the formula

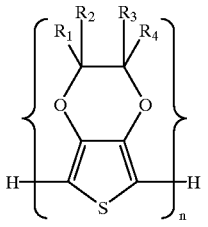

wherein each of $R_1$, $R_2$, $R_3$, and $R_4$, independently of the others, is a hydrogen atom, an alkyl group, including linear, branched, saturated, unsaturated, cyclic, and substituted alkyl groups, typically with from 1 to about 20 carbon atoms and preferably with from 1 to about 16 carbon atoms, although the number of carbon atoms can be outside of these ranges, an alkoxy group, including linear, branched, saturated, unsaturated, cyclic, and substituted alkoxy groups, typically with from 1 to about 20 carbon atoms and preferably with from 1 to about 16 carbon atoms, although the number of carbon atoms can be outside of these ranges, an aryl group, including substituted aryl groups, typically with from 6 to about 16 carbon atoms, and preferably with from 6 to about 14 carbon atoms, although the number of carbon atoms can be outside of these ranges, an aryloxy group, including substituted aryloxy groups, typically with from 6 to about 17 carbon atoms, and preferably with from 6 to about 15 carbon atoms, although the number of carbon atoms can be outside of these ranges, an arylalkyl group or an alkylaryl group, including substituted arylalkyl and substituted alkylaryl groups, typically with from 7 to about 20 carbon atoms, and preferably with from 7 to about 16 carbon atoms, although the number of carbon atoms can be outside of these ranges, an arylalkyloxy or an alkylaryloxy group, including substituted arylalkyloxy and substituted alkylaryloxy groups, typically with from 7 to about 21 carbon atoms, and preferably with from 7 to about 17 carbon atoms, although the number of carbon atoms can be outside of these ranges, a heterocyclic group, including substituted heterocyclic groups, wherein the hetero atoms can be (but are not limited to) nitrogen, oxygen, sulfur, and phosphorus, typically with from about 4 to about 6 carbon atoms, and preferably with from about 4 to about 5 carbon atoms, although the number of carbon atoms can be outside of these ranges, wherein the substituents on the substituted alkyl, alkoxy, aryl, at aryloxy, arylalkyl, alkylaryl, arylalkyloxy, alkylaryloxy, and heterocyclic groups can be (but are not limited to) hydroxy groups, halogen atoms, amine groups, imine groups, ammonium groups, cyano groups, pyridine groups, pyridinium groups, ether groups, aldehyde groups, ketone groups, ester groups, amide groups, carbonyl groups, thiocarbonyl groups, sulfate groups, sulfonate groups, sulfide groups, sulfoxide groups, phosphine groups, phosphonium groups, phosphate groups, nitrile groups, mercapto groups, nitro groups, nitroso groups, sulfone groups, acyl groups, acid anhydride groups, azide groups, mixtures thereof, and the like, as well as mixtures thereof, and wherein two or more substituents can be joined together to form a ring, and n is an integer representing the number of repeat monomer units, is applied to the particle surfaces by an oxidative polymerization process. The toner particles are suspended in a solvent in which the toner particles will not dissolve, such as water, methanol, ethanol, butanol, acetone, acetonitrile, blends of water with methanol, ethanol, butanol, acetone, acetonitrile, and/or the like, preferably in an amount of from about 5 to about 20 weight percent toner particles in the solvent, and the 3,4-ethylenedioxythiophene monomer is added slowly (a typical addition time period would be over about 10 minutes) to the solution with stirring. The 3,4-ethylenedioxythiophene monomer typically is added in an amount of from about 5 to about 15 percent by weight of the toner particles. The 3,4-ethylenedioxythiophene monomer, of the formula

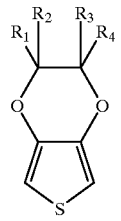

wherein $R_1$, $R_2$, $R_3$, and $R_4$ are as defined above, is hydrophobic, and it is desired that the monomer become adsorbed onto the toner particle surfaces. Thereafter, the solution is stirred for a period of time, typically from about 0.5 to about 3 hours to enable the monomer to be absorbed into the toner particle surface. When a dopant is employed, it is typically added at this stage, although it can also be added after addition of the oxidant. Subsequently, the oxidant selected is dissolved in a solvent sufficiently polar to keep the particles from dissolving therein, such as water, methanol, ethanol, butanol, acetone, acetonitrile, or the like, typically in a concentration of from about 0.1 to about 5 molar equivalents of oxidant per molar equivalent of 3,4-ethylenedioxythiophene monomer, and slowly added dropwise with stirring to the solution containing the toner particles. The amount of oxidant added to the solution typically is in a molar ratio of 1:1 or less with respect to the 3,4-ethylenedioxythiophene, although a molar excess of oxidant can also be used and can be preferred in some instances. The oxidant is preferably added to the solution subsequent to addition of the 3,4-ethylenedioxythiophene monomer so that the 3,4-ethylenedioxythiophene has had time to adsorb onto the toner particle surfaces prior to polymerization, thereby enabling the 3,4-ethylenedioxythiophene to polymerize on the toner particle surfaces instead of forming separate particles in the solution. When the oxidant addition is complete, the solution is again stirred for a period of time, typically from about 1 to about 2 days, although the time can be outside of this range, to allow the polymerization and doping process to occur. Thereafter, the toner particles having poly(3,4-ethylenedioxythiophene) polymerized on the surfaces thereof are washed, preferably with water, to remove therefrom any poly(3,4-ethylenedioxythiophene) that formed in the solution as separate particles instead of as a coating on the toner particle surfaces, and the toner particles are dried. The entire process typically takes place at about room temperature (typically from about 15 to about 30° C.), although lower temperatures can also be used if desired.

Particularly preferred $R_1$, $R_2$, $R_3$, and $R_4$ groups on the 3,4-ethylenedioxythiophene monomer and poly(3,4-ethylenedioxythiophene) polymer include hydrogen atoms, linear alkyl groups of the formula $—(CH_2)_nCH_3$ wherein n is an integer of from 0 to about 16, linear alkyl sulfonate groups of the formula $—(CH_2)_nSO_3^-M^+$ wherein n is an integer of from 1 to about 6 and M is a cation, such as sodium, potassium, other monovalent cations, or the like, and linear alkyl ether groups of the formula $—(CH_2)_nOR_3$ wherein n is an integer of from 0 to about 6 and $R_3$ is a hydrogen atom or a linear alkyl group of the formula —$(CH_2)_mCH_3$ wherein n is an integer of from 0 to about 6. Specific examples of preferred 3,4-ethylenedioxythiophene monomers include those with $R_1$ and $R_3$ as hydrogen groups and $R_2$ and $R_4$ groups as follows:

| $R_2$ | $R_4$ |
|---|---|
| H | H |
| $(CH_2)_nCH_3$ n = 0–14 | H |
| $(CH_2)_nCH_3$ n = 0–14 | $(CH_2)_nCH_3$ n = 0–14 |
| $(CH_2)_nSO_3^-Na^+$ n = 1–6 | H |
| $(CH_2)_nSO_3^-Na^+$ n = 1–6 | $(CH_2)_nSO_3^-Na^+$ n = 1–6 |
| $(CH_2)_nOR_6$ n = 0–4 $R_6$ = H, $(CH_2)_mCH_3$ m = 0–4 | H |
| $(CH_2)_nOR_6$ n = 0–4 $R_6$ = H, $(CH_2)_mCH_3$ m = 0–4 | $(CH_2)_nOR_6$ n = 0–4 $R_6$ = H, $(CH_2)_mCH_3$ m = 0–4 |

Unsubstituted 3,4-ethylenedioxythiophene monomer is commercially available from, for example Bayer A.G. Substituted 3,4-ethylenedioxythiophene monomers can be prepared by known methods. For example, the substituted thiophene monomer 3,4-ethylenedioxythiophene can be synthesized following early methods of Fager (Fager, E. W. *J. Am. Chem. Soc.* 1945, 67, 2217), Becker et al. (Becker, H. J.; Stevens, W. *Rec. Trav. Chim.* 1940, 59, 435) Guha and lyer (Guha, P. C., lyer, B. H.; *J. Ind. Inst. Sci* 1938, A21, 115), and Gogte (Gogte, V. N.; Shah, L. G.; Tilak, B. D.; Gadekar, K. N.; Sahasrabudhe, M. B.; Tetrahedron, 1967, 23, 2437). More recent references for the EDOT synthesis and 3,4-alkylenedioxythiophenes are the following: Pei, Q.; Zuccarello, G.; Ahlskog, M.; Ingonas, O. Polymer, 1994, 35(7), 1347; Heywang, G.; Jonas, F. *Adv. Mater.* 1992, 4(2), 116; Jonas, F.; Heywang, G.; *Electrochimica Acta.* 1994, 39(8/9), 1345; Sankoran, B.; Reynolds, J. R.; *Macromolecules,* 1997, 30, 2582; Coffey, M.; McKellar, B. R.; Reinhardt, B. A.; Nijakowski, T.; Feld, W. A.; *Syn. Commun.,* 1996, 26(11), 2205; Kumar, A.; Welsh, D. M.; Morvant, M. C.; Piroux, F.; Abboud, K. A.; Reynolds, J. R. *Chem. Mater.* 1998, 10, 896; Kumar, A.; Reynolds, J. R. *Macromolecules,* 1996, 29, 7629; Groenendoal, L.; Jonas, F.; Freitag, D.; Pielartzik, H.; Reynolds, J. R.; *Adv. Mater.* 2000, 12(7), 481; and U.S. Pat. No. 5,035,926, the disclosures of each of which are totally incorporated herein by reference. The synthesis of poly(3,4-ethylenedioxypyrrole)s and 3,4-ethylenedioxypyrrole monomers is also disclosed in Merz, A., Schropp, R., Dötterl, E., *Synthesis,* 1995, 795; Reynolds, J. R.; Brzezinski, J., DuBois, C. J., Giurgiu, I., Kloeppner, L., Ramey, M. B., Schottland, P., Thomas, C., Tsuie, B. M., Welsh, D. M., Zong, K., *Polym. Prepr. Am. Chem. Soc. Div. Polym. Chem,* 1999, 40(2), 1192; Thomas, C. A., Zong, K., Schottland, P., Reynolds, J. R., *Adv. Mater.,* 2000, 12(3), 222; Thomas, C. A., Schottland, P., Zong, K, Reynolds, J. R., *Polym. Prepr. Am. Chem. Soc. Div. Polym. Chem,* 1999, 40(2), 615; and Gaupp, C. L., Zong, K., Schottland, P., Thompson, B. C., Thomas, C. A., Reynolds, J. R., *Macromolecules,* 2000, 33, 1132; the disclosures of each of which are totally incorporated herein by reference.

An example of a monomer synthesis is as follows:

Thiodiglycolic acid (1, 50 grams, commercially available from Aldrich or Fluka) is dissolved in methanol (200 milliliters) and concentrated sulfuric acid (57 milliliters) is added slowly with continuous stirring. After refluxing for 16 to 24 hours, the reaction mixture is cooled and poured into water (300 milliliters). The product is extracted with diethyl ether (200 milliliters) and the organic layer is repeatedly washed with saturated aqueous $NaHCO_3$, dried with $MgSO_4$, and concentrated by rotary evaporation. The residue is distilled to give colorless dimethyl thiodiglycolate (2, 17 grams). If the solvent is changed to ethanol the resulting product obtained is diethyl thiodiglycolate (3).

A solution of 2 and diethyl oxalate (4, 22 grams, commercially available from Aldrich) in methanol (100 milliliters) is added dropwise into a cooled (0° C.) solution of sodium methoxide (34.5 grams) in methanol (150 milliliters). After the addition is completed, the mixture is refluxed for 1 to 2 hours. The yellow precipitate that forms is filtered, washed with methanol, and dried in vacuum at room temperature. A pale yellow powder of disodium 2,5-dicarbomethoxy-3,4-dioxythiophene (5) is obtained in 100 percent yield (28 grams). The disodium 2,5-dicarbethyoxy-3,4-dioxythiophene (6) derivative of 5 can also be used instead of the methoxy derivative. This material is prepared similarly to 5 except 3 and diethyl oxalate (4) in ethanol is added dropwise into a cooled solution of sodium ethoxide in ethanol.

The salt either 5 or 6 is dissolved in water and acidified with 1 Molar HCl added slowly dropwise with constant stirring until the solution becomes acidic. Immediately following, thick white precipitate falls out. After filtration, the precipitate is washed with water and air-dried to give 2,5-dicarbethoxy-3,4-dihydroxythiophene (7). The salt either (5, 2.5 grams) or 6 can be alkylated directly or the dihydrothiophene derivative (7) can be suspended in the appropriate 1,2-dihaloalkane or substituted 1,2-dihaloalkane and refluxed for 24 hours in the presence of anhydrous $K_2CO_3$ in anhydrous DMF. To prepare EDOT, either 1,2-dicholorethane (commercially available from Aldrich) or 1,2-dibromoethane (commercially from Aldrich) is used. To prepare the various substituted EDOT derivatives the appropriate 1,2-dibromoalkane is used, such as 1-dibromodecane, 1,2-dibromohexadecane (prepared from 1-hexadecene and bromine), 1,2-dibromohexane, other reported 1,2-dibromoolkane derivatives, and the like. The resulting 2,5-dicarbethoxy-3,4-ethylenedioxythiophene or 2,5-dicarbethoxy-3,4-alkylenedioxythiophene is refluxed in base, for example 10 percent aqueous sodium hydroxide solution for 1 to 2 hours, and the resulting insoluble material is collected by filtration. This material is acidified with 1 Normal HCl and recrystallized from methanol to produce either 2,5-dicarboxy-3,4-ethylenedioxythiophene or the corresponding 2,5-dicarboxy-3,4-alkylenedioxythiophene. The final step to reduce the carboxylic acid functional groups to hydrogen to produce the desired monomer is given in the references above.

Examples of suitable oxidants include water soluble persulfates, such as ammonium persulfate, potassium persulfate, and the like, cerium (IV) sulfate, ammonium cerium (IV) nitrate, ferric salts, such as ferric chloride, iron (III) sulfate, ferric nitrate nanohydrate, tris(p-toluenesulfonato)iron (III) (commercially available from Bayer under the tradename Baytron C), and the like. The oxidant is typically employed in an amount of at least about 0.1 molar equivalent of oxidant per molar equivalent of 3,4-ethylenedioxythiophene monomer, preferably at least about 0.25 molar equivalent of oxidant per molar equivalent of 3,4-ethylenedioxythiophene monomer, and more preferably at least about 0.5 molar equivalent of oxidant per molar equivalent of 3,4-ethylenedioxythiophene monomer, and typically is employed in an amount of no more than about 5 molar equivalents of oxidant per molar equivalent of 3,4-ethylenedioxythiophene monomer, preferably no more than about 4 molar equivalents of oxidant per molar equivalent of 3,4-ethylenedioxythiophene monomer, and more preferably no more than about 3 molar equivalents of oxidant per molar equivalent of 3,4-ethylenedioxythiophene monomer, although the relative amounts of oxidant and 3,4-ethylenedioxythiophene can be outside of these ranges.

The molecular weight of the poly(3,4-ethylenedioxythiophene) formed on the toner particle surfaces need not be high; typically the polymer has at least about 3 repeat 3,4-ethylenedioxythiophene units, and preferably has at least about 6 repeat 3,4-ethylenedioxythiophene units, to enable the desired toner particle conductivity. If desired, the molecular weight of the poly(3,4-ethylenedioxythiophene) formed on the toner particle surfaces can be adjusted by varying the molar ratio of oxidant to monomer (EDOT), the acidity of the medium, the reaction time of the oxidative polymerization, and/or the like. Molecular weights wherein the number of EDOT repeat monomer units is about 1,000 or higher can be employed, although higher molecular weights tend to make the material more insoluble and therefore more difficult to process. Preferably the number of repeat 3,4-ethylenedioxythiophene units is no more than about 100.

Alternatively, instead of coating the poly(3,4-ethylenedioxythiophene) onto the toner particle surfaces, the poly(3,4-ethylenedioxythiophene) can be incorporated into the toner particles during the toner preparation process. For example, the poly(3,4-ethylenedioxythiophene) polymer can be prepared during the aggregation of the toner latex process to make the toner size particles, and then as the particles coalesced, the poly(3,4-ethylenedioxythiophene) polymer can be included within the interior of the toner particles in addition to some polymer remaining on the surface. Another method of incorporating the poly(3,4-ethylenedioxythiophene) within the toner particles is to perform the oxidative polymerization of the 3,4-ethylenedioxythiophene monomer on the aggregated toner particles prior to heating for particle coalescence. As the irregular shaped particles are coalesced with the poly(3,4-ethylenedioxythiophene) polymer the polymer can be embedded or partially mixed into the toner particles as the particle coalesce. Yet another method of incorporating poly (3,4-ethylenedioxythiophene) within the toner particles is to add the 3,4-ethylenedioxythiophene monomer, dopant, and oxidant after the toner particles are coalesced and cooled but before any washing is performed. The oxidative polymerization can, if desired, be performed in the same reaction kettle to minimize the number of process steps.

In addition to polymerizing the 3,4-ethylenedioxythiophene monomer in the toner particle and/or on the toner particle surface, an aqueous dispersion of poly(3,4-ethylenedioxythiophene) (such as that commercially available under the tradename Baytron P from Bayer) can be used to produce a conductive surface on the toner particles by adding some of the aqueous dispersion of poly(3,4-ethylenedioxythiophene) to the washed aggregated/coalesced toner particles, or by adding the aqueous dispersion of poly(3,4-ethylenedioxythiophene) during the aggregation process, thereby including the poly(3,4-ethylenedioxythiophene) into the interior of the toner particles and also on the surface of the toner particles. Additionally, the aqueous dispersion of poly(3,4-ethylenedioxythiophene) can be added after aggregation but prior to coalescence; further, the aqueous dispersion of poly(3,4-ethylenedioxythiophene) can be added after aggregation and coalescence has occurred but before the particles are washed.

To achieve the desired toner particle conductivity, it is desirable for the poly(3,4-ethylenedioxythiophene) to be in its oxidized form. The poly(3,4-ethylenedioxythiophene) can be shifted to its oxidized form by doping it with dopants such as sulfonate, phosphate, or phosphonate moieties, iodine, or the like. Poly(3,4-ethylenedioxythiophene) in its doped and oxidized form is believed to be of the formula

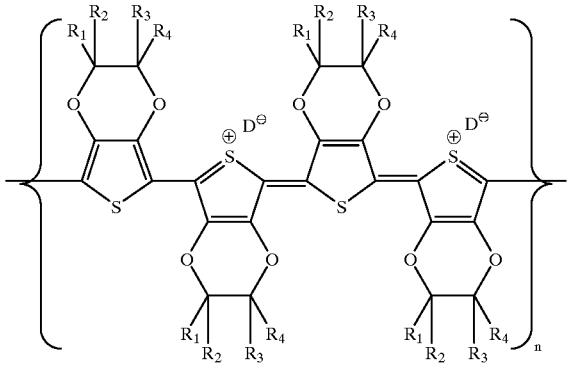

wherein $R_1$, $R_2$, $R_3$, and $R_4$ are as defined above, $D^-$ corresponds to the dopant, and n is an integer representing the number of repeat monomer units. For example, poly(3,4-ethylenedioxythiophene) in its oxidized form and doped with sulfonate moieties is believed to be of the formula

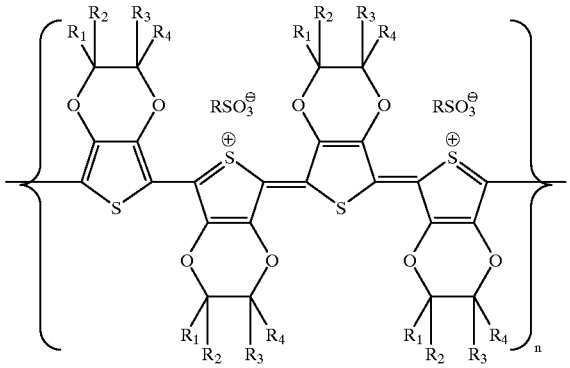

wherein $R_1$, $R_2$, $R_3$, and $R_4$ are as defined above, R corresponds to the organic portion of the sulfonate dopant molecule, such as an alkyl group, including linear, branched, saturated, unsaturated, cyclic, and substituted alkyl groups, typically with from 1 to about 20 carbon atoms and preferably with from 1 to about 16 carbon atoms, although the number of carbon atoms can be outside of these ranges, an alkoxy group, including linear, branched, saturated, unsaturated, cyclic, and substituted alkoxy groups, typically with from 1 to about 20 carbon atoms and preferably with from 1 to about 16 carbon atoms, although the number of carbon atoms can be outside of these ranges, an aryl group, including substituted aryl groups, typically with from 6 to about 16 carbon atoms, and preferably with from 6 to about 14 carbon atoms, although the number of carbon atoms can be outside of these ranges, an aryloxy group, including substituted aryloxy groups, typically with from 6 to about 17 carbon atoms, and preferably with from 6 to about 15 carbon atoms, although the number of carbon atoms can be outside of these ranges, an arylalkyl group or an alkylaryl group, including substituted arylalkyl and substituted alkylaryl groups, typically with from 7 to about 20 carbon atoms, and preferably with from 7 to about 16 carbon atoms, although the number of carbon atoms can be outside of these ranges, an arylalkyloxy or an alkylaryloxy group, including substituted arylalkyloxy and substituted alkylaryloxy groups, typically with from 7 to about 21 carbon atoms, and preferably with from 7 to about 17 carbon atoms, although the number of carbon atoms can be outside of these ranges, wherein the substituents on the substituted alkyl, alkoxy, aryl, aryloxy, arylalkyl, alkylaryl, arylalkyloxy, and alkylaryloxy groups can be (but are not limited to) hydroxy groups, halogen atoms, amine groups, imine groups, ammonium groups, cyano groups, pyridine groups, pyridinium groups, ether groups, aldehyde groups, ketone groups, ester groups, amide groups, carbonyl groups, thiocarbonyl groups, sulfate groups, sulfonate groups, sulfide groups, sulfoxide groups, phosphine groups, phosphonium groups, phosphate groups, nitrile groups, mercapto groups, nitro groups, nitroso groups, sulfone groups, acyl groups, acid anhydride groups, azide groups, mixtures thereof, and the like, as well as mixtures thereof, and wherein two or more substituents can be joined together to form a ring, and n is an integer representing the number of repeat monomer units.

One method of causing the poly(3,4-ethylenedioxythiophene) to be doped is to select as the vinyl toner resin a sulfonated vinyl toner resin. In this embodiment, some of the repeat monomer units in the vinyl polymer have sulfonate groups thereon. The sulfonated vinyl resin has surface exposed sulfonate groups that serve the dual purpose of anchoring and doping the coating layer of poly(3,4-ethylenedioxythiophene) onto the toner particle surface.

Another method of causing the poly(3,4-ethylenedioxythiophene) to be doped is to place groups such as sulfonate moieties on the toner particle surfaces during the toner particle synthesis. For example, the ionic surfactant selected for the emulsion aggregation process can be an anionic surfactant having a sulfonate group thereon, such as sodium dodecyl sulfonate, sodium dodecylbenzene sulfonate, dodecylbenzene sulfonic acid, dialkyl benzenealkyl sulfonates, such as 1,3-benzene disulfonic acid sodium salt, para-ethylbenzene sulfonic acid sodium salt, and the like, sodium alkyl naphthalene sulfonates, such as 1,5-naphthalene disulfonic acid sodium salt, 2-naphthalene disulfonic acid, and the like, sodium poly(styrene sulfonate), and the like, as well as mixtures thereof. During the emulsion polymerization process, the surfactant becomes grafted and/or adsorbed onto the latex particles that are later aggregated and coalesced. While the toner particles are washed subsequent to their synthesis to remove surfactant therefrom, some of this surfactant still remains on the particle surfaces, and in sufficient amounts to enable doping of the poly(3,4-ethylenedioxythiophene) so that it is desirably conductive.

Yet another method of causing the poly(3,4-ethylenedioxythiophene) to be doped is to add small dopant molecules containing sulfonate, phosphate, or phosphonate groups to the toner particle solution before, during, or after the oxidative polymerization of the 3,4-ethylenedioxythiophene. For example, after the toner particles have been suspended in the solvent and prior to addition of the 3,4-ethylenedioxythiophene, the dopant can be added to the solution. When the dopant is a solid, it is allowed to dissolve prior to addition of the 3,4-ethylenedioxythiophene monomer, typically for a period of about 0.5 hour. Alternatively, the dopant can be added after addition of the 3,4-ethylenedioxythiophene and before addition of the oxidant, or after addition of the oxidant, or at any other time during the process. The dopant is added to the poly(3,4-ethylenedioxythiophene) in any desired or effective amount, typically at least about 0.1 molar equivalent of dopant per molar equivalent of 3,4-ethylenedioxythiophene monomer, preferably at least about 0.25 an molar equivalent of dopant per molar equivalent of 3,4-ethylenedioxythiophene monomer, and more preferably at least about 0.5 molar equivalent of dopant per molar equivalent of 3,4-ethylenedioxythiophene monomer, and typically no more than about 5 molar equivalents of dopant per molar equivalent of 3,4-ethylenedioxythiophene monomer, preferably no more than about 4 molar equivalents of dopant per molar equivalent of 3,4-ethylenedioxythiophene monomer, and more preferably no more than about 3 molar equivalents of dopant per molar equivalent of 3,4-ethylenedioxythiophene monomer, although the amount can be outside of these ranges.

Examples of suitable dopants include p-toluene sulfonic acid, camphor sulfonic acid, dodecane sulfonic acid, benzene sulfonic acid, naphthalene sulfonic acid, dodecylbenzene sulfonic acid, sodium dodecyl sulfonate, sodium dodecylbenzene sulfonate, dialkyl benzenealkyl sulfonates, such as 1,3-benzene disulfonic acid sodium salt, para-ethylbenzene sulfonic acid sodium salt, and the like, sodium alkyl naphthalene sulfonates, such as 1,5-naphthalene disulfonic acid sodium salt, 2-naphthalene disulfonic acid, and the like, poly(styrene sulfonate sodium salt), and the like.

Still another method of doping the poly(3,4-ethylenedioxythiophene) is to expose the toner particles that have the poly(3,4-ethylenedioxythiophene) on the particle surfaces to iodine vapor in solution, as disclosed in, for example, Yamamoto, T.; Morita. A.; Miyazaki, Y.; Maruyama, T.; Wakayama, H.; Zhou, Z. H.; Nakamura, Y.; Kanbara, T.; Sasaki, S.; Kubota, K.; *Macromolecules,* 1992, 25, 1214 and Yamamoto, T.; Abla, M.; Shimizu, T.; Komarudin, D.; Lee, B-L.; Kurokawa, E. *Polymer Bulletin,* 1999, 42, 321, the disclosures of each of which are totally incorporated herein by reference.

The toner particles typically have an average bulk conductivity of at least about $10^{-11}$ Siemens per centimeter, and typically have an average bulk conductivity of no more than about 10 Siemens per centimeter, and preferably no more than about $10^{-7}$ Siemens per centimeter, although the conductivity can be outside of these ranges, for applications in which the toner particles are used in ballistic aerosol marking processes. "Average bulk conductivity" refers to the ability for electrical charge to pass through a pellet of the particles, measured when the pellet is placed between two electrodes. The particle conductivity can be adjusted by various synthetic parameters of the polymerization; reaction time, molar ratios of oxidant and dopant to 3,4-ethylenedioxythiophene monomer, temperature, and the like.

The poly(3,4-ethylenedioxythiophene) thickness on the toner particles is a function of the surface area exposed for surface treatment, which is related to toner particle size and particle morphology, spherical vs potato or raspberry. For smaller particles the weight fraction of 3,4-ethylenedioxythiophene monomer used based on total mass of particles can be increased to, for example, 20 percent from 10 or 5 percent. The coating weight typically is at least about 5 weight percent of the toner particle mass, and typically is no more than about 20 weight percent of the toner particle mass. Similar amounts are used when the poly(3,4-ethylenedioxythiophene) is present throughout the particle instead of as a coating. The solids loading of the washed toner particles can be measured using a heated balance which evaporates off the water, and, based on the initial mass and the mass of the dried material, the solids loading can be calculated. Once the solids loading is determined, the toner slurry is diluted to a 10 percent loading of toner in water. For example, for 20 grams of toner particles the total mass of toner slurry is 200 grams and 2 grams of 3,4-ethylenedioxythiophene is used. Then the 3,4-ethylenedioxythiophene and other reagents are added as indicated hereinabove. For a 5 micron toner particle using a 10 weight percent of 3,4-ethylenedioxythiophene, 2 grams for 20 grams of toner particles the thickness of the conductive polymer shell was 20 nanometers. Depending on the surface morphology, which also can change the surface area, the shell can be thicker or thinner or even incomplete.

Unlike most other conductive polymer films, which typically are opaque and/or blue-black, the coatings of poly(3,4-ethylenedioxythiophene) in its oxidized form on the toner particles of the present invention are nearly non-colored and transparent, and can be coated onto toner particles of a wide variety of colors without impairing toner color quality. In addition, the use of a conductive polymeric coating on the toner particle to impart conductivity thereto is believed to be superior to other methods of imparting conductivity, such as blending with conductive surface additives, which con result in disadvantages such as reduced toner transparency, impaired gloss features, and impaired fusing performance.

The marking materials of the present invention typically exhibit interparticle cohesive forces of no more than about 20 percent, and preferably of no more than about 10 percent, although the interparticle cohesive forces can be outside of this range. There is no lower limit on interparticle cohesive forces; ideally this value is 0.

The marking materials of the present invention typically are capable of exhibiting triboelectric surface charging of from about + or −2 to about + or −60 mircrocoulombs per gram, and preferably of from about + or −10 to about + or −50 mircrocoulombs per gram, although the triboelectric charging capability can be outside of these ranges.

In the ballistic aerosol marking apparatus, high velocity gas jets in combination with the venturi convergence/divergence structure of the channels generally enables production of a gas stream of marking particles that exit the channels and remain collimated in a narrow stream well beyond the end of the channel. This collimation of the gas stream is not expected beyond the exit point for a straight tube unless the gas velocity is low. Fluid modeling also predicts that small diameter particles in a gas stream travelling at high velocity through channels with a venturi structure will remain collimated well beyond the exit point of the channel, and predicts that similar particles travelling through straight capillary tubes under similar conditions will not remain collimated beyond the channel exit point.

Testing with conventional toner particles of the type commonly used in electrostatographic imaging processes produces results similar to those predicted by the model. For example, when a Canon® CLC-500 toner and a Xerox® DocuColor® 70 toner were employed in a ballistic aerosol marking apparatus with straight channels, the particle stream exiting the straight channels spread significantly in both instances. Depending on the inner diameter of the straight channel and the particle velocity, the particle stream was observed to spread up to 15 to 20 times the diameter of the channel.

In contrast the marking materials of the present invention, when employed in a ballistic aerosol marking apparatus with straight channels under similar conditions, the exiting particle stream remained substantially more collimated than that observed for the conventional toners.

To enable very small images to be generated by the ballistic aerosol direct marking process, specific and demanding requirements are placed on the marking material. Since the channels in the ballistic aerosol marking apparatus are narrow, the marking material particle size preferably is relatively small. In addition, the particle size distribution preferably is relatively narrow; even a small fraction of large particles (for example, particles substantially greater than about 10 microns in diameter when the channel is from about 40 to about 75 microns in inner diameter) in the marking material can clog or block the channels and stop the flow of marking material exiting the channels. Further, to enable the marking material to flow smoothly and evenly through the channels (either straight or of venturi configuration), the flow properties of the marking material particles preferably are superior to those observed with conventional electrostatographic toner particles; the particle-to-particle cohesive forces preferably are low, a result that is difficult to achieve as the particles decrease in size, since with decreasing size the particle-to-particle cohesive forces increase. It can be particularly challenging to achieve good flow of small marking particles, for example those less than about 7 microns in diameter.

Ballistic aerosol marking processes entail the use of air or other gases as the marking material transport medium to move the marking particles. The polymers commonly used to form the toner particles are frequently insulative materials; for example, styrene/acrylate copolymers and sulfonated polyester polymers typically exhibit conductivity values of from about $10^{-16}$ to less than about $10^{-12}$ Siemens per centimeter. When the toner particles are fluidized in the ballistic aerosol marking apparatus via air flow, the particles can accumulate surface charge, sticking to the walls of the apparatus and forming aggregates of particles as a result of the electrostatic charge that builds up on the particle surfaces. The conductive coatings on the toner particles increase the particle conductivity and enable improved marking particle flow. In addition, the conductive coatings also allow some degree of surface charge to be formed on the toner particle surfaces, which, as indicated hereinabove, can be desirable for purposes such as metering the marking material.

The polarity to which the toner particles of the present invention can be charged can be determined by the choice of oxidant used during the oxidative polymerization of the 3,4-ethylenedioxythiophene monomer. For example, using oxidants such as ammonium persulfate and potassium persulfate for the oxidative polymerization of the 3,4-ethylenedioxythiophene monomer tends to result in formation of toner particles that become negatively charged when subjected to triboelectric or inductive charging processes. Using oxidants such as ferric chloride and tris(p-toluenesulfonato)iron (III) for the oxidative polymerization of the 3,4-ethylenedioxythiophene monomer tends to result in formation of toner particles that become positively charged when subjected to triboelectric or inductive charging processes. Accordingly, toner particles can be obtained with the desired charge polarity without the need to change the toner resin composition, and can be achieved independently of any dopant used with the poly(3,4-ethylenedioxythiophene).

Specific embodiments of the invention will now be described in detail. These examples are intended to be illustrative, and the invention is not limited to the materials, conditions, or process parameters set forth in these embodiments. All parts and percentages are by weight unless otherwise indicated.

The particle flow values of the marking materials were measured with a Hosokawa Micron Powder tester by applying a 1 millimeter vibration for 90 seconds to 2 grams of the marking particles on a set of stacked screens. The top screen contained 150 micron openings, the middle screen contained 75 micron openings, and the bottom screen contained 45 micron openings. The percent cohesion is calculated as follows:

$$\% \text{ cohesion}=50\cdot A+30\cdot B+10\cdot C$$

wherein A is the mass of marking material remaining on the 150 micron screen, B is the mass of marking material remaining on the 75 micron screen, and C is the mass of marking material remaining on the 45 micron screen. (The equation applies a weighting factor proportional to screen size.) This test method is further described in, for example, R. Veregin and R. Bartha, Proceedings of IS&T 14th International Congress on Advances in Non-Impact Printing Technologies, pg 358–361, 1998, Toronto, the disclosure of which is totally incorporated herein by reference. For the ballistic aerosol marking materials, the input energy applied to the apparatus of 300 millivolts was decreased to 50 millivolts to increase the sensitivity of the test. The lower the percent cohesion value, the better the toner flowability.

Conductivity values of the marking materials was determined by preparing pellets of each material under 1,000 to 3,000 pounds per square inch and then applying 10 DC volts across the pellet. The value of the current flowing was then recorded, the pellet was removed and its thickness measured, and the bulk conductivity for the pellet was calculated in Siemens per centimeter.

EXAMPLE I

Toner particles were prepared by aggregation of a styrene/n-butyl acrylate/acrylic acid latex using a flocculate poly (aluminum chloride) followed by particle coalescence at elevated temperature. The polymeric latex was prepared by the emulsion polymerization of styrene/n-butyl acrylate/acrylic acid (monomer ratio 82 parts by weight styrene, 18 parts by weight n-butyl acrylate, 2 parts by weight acrylic acid) in a nonionic/anionic surfactant solution (40.0 percent by weight solids) as follows: 279.6 kilograms of styrene, 61.4 kilograms of n-butyl acrylate, 6.52 kilograms of acrylic acid, 3.41 kilograms of carbon tetrabromide, and 11.2 kilograms of dodecanethiol were mixed with 461 kilograms of deionized water, to which had been added 7.67 kilograms of sodium dodecyl benzene sulfonate anionic surfactant (Neogen RK; contained 60 percent active component), 3.66 kilograms of a nonophenol ethoxy nonionic surfactant (Antarox CA-897; contained 100 percent active material), and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting latex contained 59.5 percent by weight water and 40.5 percent by weight solids, which solids comprised particles of a random copolymer of poly(styrene/n-butyl acrylate/acrylic acid); the glass transition temperature of the latex dry sample was 47.7° C., as measured on a DuPont DSC. The latex had a weight average molecular weight of 30,600 and a number average molecular weight of 4,400 as determined with a Waters gel permeation chromatograph. The particle size of the latex as measured on a Disc Centrifuge was 278 nanometers.

375 grams of the styrene/n-butyl acrylate/acrylic acid anionic latex thus prepared was then diluted with 761.43 grams of deionized water. The diluted latex solution was blended with an acidic solution of the flocculant, 3.35 grams of poly(aluminum chloride) in 7.86 grams of 1 molar nitric acid solution, using a high shear homogenizer at 4,000 to 5,000 revolutions per minute for 2 minutes, producing a flocculation or heterocoagulation of gelled particles consisting of nanometer sized latex particles. The slurry was heated at a controlled rate of 0.25° C. per minute to 50° C., at which point the average marking particle size was 4.5 microns and the particle size distribution was 1.17. At this point the pH of the solution was adjusted to 7.0 using 4 percent sodium hydroxide solution. The mixture was then heated at a controlled rate of 0.5° C. per minute to 95° C. Once the particle slurry reacted, the pH was dropped to 5.0 using 1 Molar nitric acid, followed by maintenance of the temperature at 95° C. for 6 hours. After cooling the reaction mixture to room temperature, the particles were washed and reslurried in deionized water. The average particle size of the toner particles was 5.4 microns and the particle size distribution was 1.26. A total of 5 washes were performed before the particle surface was treated by the in situ polymerization of the conductive polymer.

Into a 250 milliliter beaker was added 120 grams of the pigmentless toner size particle slurry (average particle diameter 5.4 microns; particle size distribution GSD 1.26) thus prepared, providing a total of 19.8 grams of solid material in the solution. The solution was then further diluted with deionized water to create a 200 gram particle slurry. Into this stirred solution was dissolved the oxidant ammonium persulfate (8.04 grams; 0.03525 mole). After 15 minutes, 2 grams (0.0141 mole) of 3,4-ethylenedioxythiophene monomer (EDOT) diluted in 5 milliliters of acetonitrile was added to the solution. The molar ratio of oxidant to EDOT was 2.5:1, and EDOT was present in an amount of 10 percent by weight of the toner particles. The reaction was stirred for 15 minutes, followed by the addition of 2 grams of the external dopant para-toluene sulfonic acid (p-TSA) dissolved in 10 milliliters of water. The solution was stirred overnight at room temperature. The resulting blue-green toner particles (with the slight coloration being the result of the poly(3,4-ethylenedioxythiophene) (PEDOT) particle coating) were washed 7 times with distilled water and then dried with a freeze dryer for 48 hours. The chemical oxidative polymerization of EDOT to produce PEDOT occurred on the toner particle surface, and the particle surfaces were rendered conductive by the presence of the sulfonate groups from the toner particle surfaces and by the added p-TSA. The measured average bulk conductivity of a pressed pellet of this toner was $\sigma=1.10\times10^{-7}$ Siemens per centimeter. The conductivity was determined by preparing a pressed pellet of the material under 1,000 to 3,000 pounds per square inch of pressure and then applying 10 DC volts across the pellet. The value of the current flowing through the pellet was recorded, the pellet was removed and its thickness measured, and the bulk conductivity for the pellet was calculated in Siemens per centimeter.

The conductive toner particles were charged by blending 24 grams of carrier particles (65 micron Hoeganes core having a coating in an amount of 1 percent by weight of the carrier, said coating comprising a mixture of poly(methyl methacrylate) and SC Ultra carbon black in a ratio of 80 to 20 by weight) with 1.0 gram of toner particles to produce a developer with a toner concentration (Tc) of 4 weight percent. This mixture was conditioned overnight at 50 percent relative humidity at 22° C., followed by roll milling the developer (toner and carrier) for 30 minutes to reach a stable developer charge. The total toner blow off method was used to measure the average charge ratio (Q/M) of the developer with a Faraday Cage apparatus (such as described at column 11, lines 5 to 28 of U.S. Pat. No. 3,533,835, the disclosure of which is totally incorporated herein by reference). The conductive particles reached a triboelectric charge of 5.5 mircrocoulombs per gram. The flow properties of this toner were measured with a Hosakawa powder flow tester to be 4.5 percent cohesion. Scanning electron micrographs (SEM) of the treated particles indicated that a surface coating was indeed on the surface, and transmission electron micrographs indicated that the surface layer of PEDOT was 20 nanometers thick.

Comparative Example A

For comparative purposes, the average bulk conductivity of a pressed pellet of the pigmentless toner particles provided in the first Slurry in Example I prior to reaction with the other ingredients was measured at $7.2\times10^{-15}$ Siemens per centimeter. The conductive toner particles were charged by blending 24 grams of carrier particles (65 micron Hoeg ánes core having a coating in an amount of 1 percent by weight of the carrier, said coating comprising a mixture of poly(methyl methacrylate) and SC Ultra carbon black in a ratio of 80 to 20 by weight) with 1.0 gram of toner particles to produce a developer with a toner concentration (Tc) of 4 weight percent. This mixture was conditioned overnight at 50 percent relative humidity at 22° C., followed by roll milling the developer (toner and carrier) for 30 minutes to reach a stable developer charge. The total toner blow off method was used to measure the average charge ratio (Q/M) of the developer with a Faraday Cage apparatus (such as described at column 11, lines 5 to 28 of U.S. Pat. No. 3,533,835, the disclosure of which is totally incorporated herein by reference). The conductive particles reached a triboelectric charge of 0.51 microCoulombs per gram. The flow properties of this toner were measured with a Hosakawa powder flow tester to be 21.4 percent cohesion.

Comparative Example B

For comparative purposes, 150 gram portions of a pigmentless toner particle slurry consisting of 11.25 grams of solid toner particles prepared as described in Example I were added into five separate 250 milliliter beakers. These experiments were performed to determine if oxidative polymerization of the monomer occurred in the absence of an oxidant such as ammonium persulfate. After measuring the pH of the pigmentless toner slurry (pH=6.0), to the first container was slowly added 0.45 grams of 3,4-ethylenedioxythiophene (EDOT) monomer (4 percent by weight of particles) obtained from Bayer and let stir overnight. After the particles were washed by filtration and resuspending in deionized water 6 times, they were dried by freeze drying. The average particle size was 5.1 microns with a particle size distribution of 1.22. The bulk conductivity of a pressed pellet of this sample was measured to be $3.0\times10^{-15}$ Siemens per centimeter, indicating that insufficient or no polymerization of the EDOT onto the particle surfaces occurred.

To the second beaker was added dropwise 2 Normal sulfuric acid to a pH level of 2.7. To this acidified solution was then added 0.45 grams of 3,4-ethylenedioxythiophene (EDOT) monomer (4 percent by weight of particles) (obtained from Bayer) and allowed to stir overnight. The white particles slurry had turned to a bluey-green solution. After the particles were washed by filtration and resuspended in deionized water 6 times, they were dried by freeze drying. The average particle size was 5.2 microns with a particle size distribution of 1.23. The bulk conductivity of a pressed pellet of this sample was measured to be $4.7\times10^{-15}$ Siemens per centimeters, indicating that insufficient or no polymerization of the EDOT onto the particle surfaces occurred.

To the third beaker was added 1.125 grams of poly(3,4-ethylenedioxythiophene), PEDOT polymer (10 percent by weight of particles) (obtained from Bayer) and allowed to stir overnight. After the particles were washed by filtration and resuspended in deionized water 6 times, they were dried by freeze drying. The average particle size was 5.1 microns with a particle size distribution of 1.22. The bulk conductivity of a pressed pellet of this sample was measured to be $7.4\times10^{-15}$ Siemens per centimeter, indicating that insufficient or no in deposition of the PEDOT onto the particle surfaces occurred.

To the fourth beaker was added 1.125 grams of 3,4-ethylenedioxythiophene (EDOT) monomer (10 percent by weight of particles) (obtained from Bayer) and allowed to stir overnight. The solution was clear and colorless with no visible indication of oxidative polymerization. After the particles were washed by filtration and resuspended in deionized water 6 times, they were dried by freeze drying. The average particle size was 5.2 microns with particle size distribution of 1.23. The bulk conductivity of a pressed pellet of this sample was measured to be $1.0\times10^{-14}$ Siemens per centimeters, indicating that insufficient or no polymerization of the EDOT onto the particle surfaces occurred.

To the fifth beaker was added the dopant para-toluene sulfonic acid (p-TSA) to pH=2.7. Thereafter, 0.45 gram of 3,4-ethylenedioxythiophene (EDOT) monomer (4 percent by weight of particles) (obtained from Bayer) was added and allowed to stir overnight. The supernatant was bluey-green after 24 hours. After the particles were washed by filtration and resuspending in deionized water 6 times, they were dried by freeze drying. The average particle size was 5.6 microns with a particle size distribution of 1.24. The bulk conductivity of a pressed pellet of this sample was measured to be $9.9\times10^{-15}$ Siemens per centimeters, indicating that insufficient or no polymerization of the EDOT onto the particle surfaces occurred.

EXAMPLE II

Toner particles were prepared by aggregation of a styrene/n-butyl acrylate/acrylic acid latex using a flocculate poly (aluminum chloride) followed by particle coalescence at elevated temperature. The polymeric latex was prepared by the emulsion polymerization of styrene/n-butyl acrylate/acrylic acid (monomer ratio 82 parts by weight styrene, 18 parts by weight n-butyl acrylate, 2 parts by weight acrylic acid) in a nonionic/anionic surfactant solution (40.0 percent by weight solids) as follows: 279.6 kilograms of styrene, 61.4 kilograms of n-butyl acrylate, 6.52 kilograms of acrylic acid, 3.41 kilograms of carbon tetrabromide. and 11.2 kilograms of dodecanethiol were mixed with 461 kilograms of deionized water, to which had been added 7.67 kilograms of sodium dodecyl benzene sulfonate anionic surfactant (Neogen RK; contained 60 percent active component), 3.66 kilograms of a nonophenol ethoxy nonionic surfactant (Antarox CA-897; contained 100 percent active material), and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting latex contained 59.5 percent by weight water and 40.5 percent by weight solids, which solids comprised particles of a random copolymer of poly(styrene/n-butyl acrylate/acrylic acid); the glass transition temperature of the latex dry sample was 47.7° C., as measured on a DuPont DSC. The latex had a weight average molecular weight of 30,600 and a number average molecular weight of 4,400 as determined with a Waters gel permeation chromatograph. The particle size of the latex as measured on a Disc Centrifuge was 278 nanometers.

375 grams of the styrene/n-butyl acrylate/acrylic acid anionic latex thus prepared was then diluted with 761.43 grams of deionized water. The diluted latex solution was blended with an acidic solution of the flocculant, 3.345 grams of poly(aluminum chloride) in 7.86 grams of 1 molar nitric acid solution, using a high shear homogenizer at 4,000 to 5,000 revolutions per minute for 2 minutes, producing a flocculation or heterocoagulation of gelled particles consisting of nanometer sized latex particles. The slurry was heated at a controlled rate of 0.25° C. per minute to 53° C., at which point the average marking particle size was 5.2 microns and the particle size distribution was 1.20. At this point the pH of the solution was adjusted to 7.2 using 4 percent sodium hydroxide solution. The mixture was then heated at a controlled rate of 0.5° C. per minute to 95° C. Once the particle slurry reacted, the pH was dropped to 5.0 using 1 Molar nitric acid, followed by maintenance of the temperature at 95° C. for 6 hours. After cooling the reaction mixture to room temperature, the particles were washed and reslurried in deionized water. The average particle size of the toner particles was 5.6 microns and the particle size distribution was 1.24. A total of 5 washes were performed before the particle surface was treated by the in situ polymerization of the conductive polymer.

Into a 250 milliliter beaker was added 150 grams of the pigmentless toner size particle slurry (average particle diameter 5.6 microns; particle size distribution GSD 1.24) thus prepared, providing a total of 25.0 grams of solid material in the solution. The solution was then further diluted with deionized water to create a 250 gram particle slurry. The pH of the particle slurry was measured to be 6.24. Into this stirred solution was added 3.35 grams (0.0176 mole) of the dopant para-toluene sulfonic acid (p-TSA), and the pH was then measured as 1.22. After 15 minutes, 2.5 grams (0.0176 mole) of 3,4-ethylenedioxythiophene monomer (EDOT) was added to the solution. The molar ratio of dopant to EDOT was 1:1, and EDOT was present in an amount of 10 percent by weight of the toner particles. After 2 hours, the dissolved oxidant ammonium persulfate (4.02 grams (0.0176 mole) in 10 milliliters of deionized water) was added dropwise over a 10 minute period. The molar ratio of oxidant to EDOT was 1:1. The solution was then stirred overnight at room temperature and thereafter allowed to stand for 3 days. The resulting bluish toner particles (with the slight coloration being the result of the PEDOT particle coating) were washed 7 times with distilled water and then dried with a freeze dryer for 48 hours. The chemical oxidative polymerization of EDOT to produce PEDOT occurred on the toner particle surface, and the particle surfaces were rendered conductive by the presence of the sulfonate groups from the toner particle surfaces and by the added p-TSA. The measured average bulk conductivity of a pressed pellet of this toner was $\sigma=3.9\times10^{-3}$ Siemens per centimeter. The bulk conductivity was remeasured one week later and found to be $\sigma=4.5\times10^{-3}$ Siemens per centimeter. This remeasurement was performed to determine if the conductivity level was stable over time.

EXAMPLE III

Toner particles were prepared as described in Example II. Into a 250 milliliter beaker was added 150 grams of the pigmentless toner size particle slurry (average particle diameter 5.6 microns; particle size distribution GSD 1.24) thus prepared, providing a total of 25.0 grams of solid material in the solution. The solution was then further diluted with deionized water to create a 250 gram particle slurry. The pH of the particle slurry was measured to be 6.02. Into this stirred solution was added 8.37 grams (0.0440 mole) of the dopant paro-toluene sulfonic acid (p-TSA) and the pH was measured as 0.87. After 15 minutes, 2.5 grams (0.0176 mole) of 3,4-ethylenedioxythiophene monomer (EDOT) was added to the solution. The molar ratio of dopant to EDOT was 2.5:1, and EDOT was present in an amount of 10 percent by weight of the toner particles. After 2 hours, the dissolved oxidant (ammonium persulfate 5.02 grams (0.0219 mole) in 10 milliliters of deionized water) was added dropwise over a 10 minute period. The molar ratio of oxidant to EDOT was 1.25:1. The solution was stirred overnight at room temperature and then allowed to stand for 3 days. The resulting bluish toner particles (with the slight coloration being the result of the PEDOT particle coating) were washed 7 times with distilled water and then dried with a freeze dryer for 48 hours. The chemical oxidative polymerization of EDOT to produce PEDOT occurred on the toner particle surface, and the particle surfaces were rendered conductive by the presence of the sulfonate groups from the toner particle surfaces and by the added p-TSA. The measured average bulk conductivity of a pressed pellet of this toner was $\sigma=4.9\times10^{-3}$ Siemens per centimeter. The bulk conductivity was remeasured one week later and found to be $\sigma=3.7\times10^{-3}$ Siemens per centimeter. This remeasurement was done to determine if the conductivity level was stable over time.

EXAMPLE IV

Cyan toner particles were prepared by aggregation of a styrene/n-butyl acrylate/acrylic acid latex using a flocculate poly(aluminum chloride) followed by particle coalescence at elevated temperature. The polymeric latex was prepared by the emulsion polymerization of styrene/n-butyl acrylate/acrylic acid (monomer ratio 82 parts by weight styrene, 18 parts by weight n-butyl acrylate, 2 parts by weight acrylic acid) in a nonionic/anionic surfactant solution (40.0 percent by weight solids) as follows: 279.6 kilograms of styrene, 61.4 kilograms of n-butyl acrylate, 6.52 kilograms of acrylic acid, 3.41 kilograms of carbon tetrabromide, and 11.2 kilograms of dodecanethiol were mixed with 461 kilograms of deionized water, to which had been added 7.67 kilograms of sodium dodecyl benzene sulfonate anionic surfactant (Neogen RK; contained 60 percent active component), 3.66 kilograms of a nonophenol ethoxy nonionic surfactant (Antarox CA-897; contained 100 percent active material), and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting latex contained 59.5 percent by weight water and 40.5 percent by weight solids, which solids comprised particles of a random copolymer of poly(styrene/n-butyl acrylate/acrylic acid); the glass transition temperature of the latex dry sample was 47.7° C., as measured on a DuPont DSC. The latex had a weight average molecular weight of 30,600 and a number average molecular weight of 4,400 as determined with a Waters gel permeation chromatograph. The particle size of the latex as measured on a Disc Centrifuge was 278 nanometers.

The cyan toner particles were prepared using the latex thus prepared, wherein the toner particles consisted of 70 percent by weight of the latex mixed with pigment to prepare the particle cores and 30 percent by weight of the same latex used to form shells around the pigmented cores. Into a 2 liter glass reaction kettle was added 249.4 grams of the styrene/n-butyl acrylate/acrylic acid anionic latex thus prepared and diluted with 646.05 grams of deionized water. To the diluted latex solution was added 14.6 grams of BHD 6000 pigment dispersion (obtained from Sun Chemical, containing 51.4 percent by weight solids of pigment blue cyan 15:3) dispersed into sodium dodecyl benzene sulfonate anionic surfactant (Neogen R) solution. The pigmented latex solution was blended with an acidic solution of the flocculant (3.2 grams of poly(aluminum chloride) in 7.5 grams of 1 molar nitric acid solution) using a high shear homogenizer at 4,000 to 5,000 revolutions per minute for 2 minutes, producing a flocculation or heterocoagulation of gelled particles consisting of nanometer sized pigmented latex particles. The slurry was heated at a controlled rate of 0.25° C. per minute to 50° C., at which point the average marking particle size was 4.75 microns and the particle size distribution was 1.20. At this point 106.98 grams of the above latex was added to aggregate around the already toner sized pigmented cores to form polymeric shells. After an additional 2 hours at 50° C., the aggregated particles had an average particle size of 5.55 microns and a particle size distribution of 1.33. At this point, the pH of the solution was adjusted to in 8.0 using 4 percent sodium hydroxide solution. The mixture was then heated at a controlled rate of 0.5° C. per minute to 96° C. After the particle slurry had maintained the reaction temperature of 96° C. for 1 hour, the pH was dropped to 5.5 using 1 molar nitric acid, followed by maintenance of this temperature for 6 hours. After cooling the reaction go mixture to room temperature, the particles were washed and reslurried in deionized water. The average particle size of the toner particles was 5.6 microns and the particle size distribution was 1.24. A total of 5 washes were performed before the particle surface was treated by the in situ polymerization of the conductive polymer.

Into a 250 milliliter beaker was added 150 grams of the cyan toner size particle slurry (average particle diameter 5.6 microns; particle size distribution GSD 1.24) thus prepared, providing a total of 18.7 grams of solid material in the solution. The solution was then further diluted with deionized water to create a 200 gram particle slurry. Into this stirred solution was added 1.25 grams (0.00658 mole) of the dopant para-toluene sulfonic acid (p-TSA) and the pH was measured as 2.4. After 15 minutes, 1.87 grams (0.0132 mole) of 3,4-ethylenedioxythiophene monomer (EDOT) diluted in 2 milliliters of acetonitrile was added to the solution. The molar ratio of dopant to EDOT was 0.5:1, and EDOT was present in an amount of 10 percent by weight of the toner particles. After 1 hour, the dissolved oxidant ammonium persulfate (7.53 grams (0.033 mole) in 10 milliliters of deionized water) was added dropwise over a 10 minute period. The molar ratio of oxidant to EDOT was 2.5:1. The solution was then stirred overnight at room temperature. The resulting bluish toner particles (with the slight coloration being the result of the PEDOT particle coating) in a yellowish supernatant solution were washed 5 times with distilled water and then dried with a freeze dryer for 48 hours. The solution conductivity was measured on the supernatant using an Accumet Research AR20 pH/conductivity meter purchased from Fisher Scientific and found to be $5.499\times10^{-2}$ Siemens per centimeter. The chemical oxidative polymerization of EDOT to produce PEDOT occurred on the toner particle surface, and the particle surfaces were rendered semi-conductive by the presence of the sulfonate groups from the toner particle surfaces and by the added p-TSA. The measured average bulk conductivity of a pressed pellet of this toner was $\sigma=1.9\times10-9$ Siemens per centimeter.

EXAMPLE V

Cyan toner particles were prepared as described in Example IV. Into a 250 milliliter beaker was added 150 grams of the cyan toner size particle slurry (average particle diameter 5.6 microns; particle size distribution GSD 1.24) thus prepared, providing a total of 18.7 grams of solid material in the solution. The solution was then further diluted with deionized water to create a 200 gram particle slurry. Into this stirred solution was added 2.51 grams (0.0132 mole) of the dopant para-toluene sulfonic acid (p-TSA) and the pH was measured as 0.87. After 15 minutes, 1.87 grams (0.0132 mole) of 3,4-ethylenedioxythiophene monomer (EDOT) was added to the solution. The molar ratio of dopant to EDOT was 1:1, and EDOT was present in an amount of 10 percent by weight of the toner particles. After 2 hours, the dissolved oxidant ammonium persulfate (7.53 grams (0.033 mole) in 10 milliliters of deionized water) was added dropwise over a 10 minute period. The molar ratio of oxidant to EDOT was 2.5:1. The solution was then stirred overnight at room temperature. The resulting bluish toner particles (with the slight coloration being the result of the PEDOT particle coating) in a yellowish supernatant solution were washed 5 times with distilled water and then dried with a freeze dryer for 48 hours. The solution conductivity was measured on the supernatant using an Accumet Research AR20 pH/conductivity meter purchased from Fisher Scientific and found to be $5.967\times10^{-2}$ Siemens per centimeter. The chemical oxidative polymerization of EDOT to produce PEDOT occurred on the toner particle surface, and the particle surfaces were rendered semi-conductive by the presence of the sulfonate groups from the toner particle surfaces and by the added p-TSA. The measured average bulk conductivity of a pressed pellet of this toner was $\sigma=1.3\times10^{-7}$ Siemens per centimeter.

EXAMPLE VI

Unpigmented toner particles were prepared by aggregation of a styrene/n-butyl acrylate/acrylic acid latex using a flocculant (poly(aluminum chloride)) followed by particle coalescence at elevated temperature. The polymeric latex was prepared by the emulsion polymerization of styrene/n-butyl acrylate/acrylic acid (monomer ratio 82 parts by weight styrene, 18 parts by weight n-butyl acrylate, 2 parts by weight acrylic acid) in a nonionic/anionic surfactant solution (40.0 percent by weight solids) as follows; 279.6 kilograms of styrene, 61.4 kilograms of n-butyl acrylate, 6.52 kilograms of acrylic acid, 3.41 kilograms of carbon tetrabromide, and 11.2 kilograms of dodecanethiol were mixed with 461 kilograms of deionized water in which had been dissolved 7.67 kilograms of sodium dodecyl benzene sulfonate anionic surfactant (Neogen RK; contains 60 percent active component), 3.66 kilograms of a nonophenol ethoxy nonionic surfactant (Antarox CA-897, 100 percent active material), and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting latex contained 59.5 percent by weight water and 40.5 percent by weight solids, which solids comprised particles of a random copolymer of poly(styrene/n-butyl acrylate/acrylic acid): the glass transition temperature of the latex dry sample was 47.7° C., as measured on a DuPont DSC. The latex had a weight average molecular weight of 30,600 and a number average molecular weight of 4,400 as determined with a Waters gel permeation chromatograph. The particle size of the latex as measured on a Disc Centrifuge was 278 nanometers.

Thereafter 375 grams of the styrene/n-butyl acrylate/acrylic acid anionic latex thus prepared was diluted with 761.43 grams of deionized water. The diluted latex solution was blended with an acidic solution of the flocculant (3.35 grams of poly(aluminum chloride) in 7.86 grams of 1 molar nitric acid solution) using a high shear homogenizer at 4,000 to 5,000 revolutions per minute for 2 minutes, producing a flocculation or heterocoagulation of gelled particles consisting of nanometer sized latex particles. The slurry was heated at a controlled rote of 0.25° C. per minute to 50° C., at which point the average marking particle size was 4.5 microns and the particle size distribution was 1.17. At this point the pH of the solution was adjusted to 7.0 using 4 percent sodium hydroxide solution. The mixture was then heated at a controlled rate of 0.5° C. per minute to 95° C. Once the particle slurry reacted at the reaction temperature of 95° C., the pH was dropped to 5.0 using 1 molar nitric acid, followed by maintenance of this temperature for 6 hours. The particles were then cooled to room temperature. From this toner slurry 150 grams was removed and washed 6 times by filtration and resuspension in deionized water. The particles were then dried with a freeze dryer for 48 hours. The average particle size of the toner particles was 5.7 microns and the particle size distribution was 1.24.

Into a 250 milliliter beaker was added 150 grams of the pigmentless toner size particle slurry thus prepared providing a total of 11.25 grams of solid material in the solution. The pH of the solution was then adjusted by adding the dopant, paratoluene sulfonic acid (pTSA) until the pH was 2.73. Into this stirred solution was dissolved the oxidant ammonium persulfate (1.81 grams; 7.93 mmole). After 15 minutes, 0.45 grams (3.17 mmole) of 3,4-ethylenedioxythiophene monomer (EDOT) was added to the solution. The molar ratio of oxidant to EDOT was 2.5:1, and EDOT was present in an amount of 4 percent by weight of the toner particles. The reaction was stirred overnight at room temperature. The resulting greyish toner particles (with the slight coloration being the result of the PEDOT particle coating) were washed 6 times with distilled water and then dried with a freeze dryer for 48 hours. The chemical oxidative polymerization of EDOT to produce PEDOT occurred on the toner particle surface, and the particle surfaces were rendered slightly conductive by the presence of the sulfonate groups from the toner particle surfaces and by the added pTSA. The average particle size of the toner particles was 5.1 microns and the particle size distribution was 1.24. The bulk conductivity of this sample when pressed into a pellet was $3.1\times10^{-13}$ Siemens per centimeter. The conductive toner particles were charged by blending 24 grams of carrier particles (65 micron Hoegánes core having a coating in an amount of 1 percent by weight of the carrier, said coating comprising a mixture of poly(methyl methacrylate) and SC Ultra carbon black in a ratio of 80 to 20 by weight) with 1.0 gram of toner particles to produce a developer with a toner concentration (Tc) of 4 weight percent. This mixture was conditioned overnight at 50 percent relative humidity at 22° C., followed by roll milling the developer (toner and carrier) for 30 minutes to reach a stable developer charge. The total toner blow off method was used to measure the average charge ratio (Q/M) of the developer with a Faraday Cage apparatus (such as described at column 11, lines 5 to 28 of U.S. Pat. No. 3,533,835, the disclosure of which is totally incorporated herein by reference). The conductive particles reached a triboelectric charge of −36.3 microCoulombs per gram.

EXAMPLE VII

Unpigmented toner particles were prepared by the method described in Example VI. Into a 250 milliliter beaker was added 150 grams of a pigmentless toner size particle slurry (average particle diameter 5.7 microns; particle size distribution GSD 1.24) providing a total of 20.0 grams of solid material in the solution. The pH of the solution was not adjusted before the oxidant was added. Into this stirred solution was dissolved the oxidant ammonium persulfate (3.7 grams; 0.0162 mole). After 15 minutes, 2.0 grams (0.0141 mole) of 3,4-ethylenedioxythiophene monomer (EDOT) was added to the solution. The molar ratio of oxidant to EDOT was 1.1:1, and EDOT was present in an amount of 10 percent by weight of the toner particles. The reaction was stirred overnight at room temperature. The resulting greyish toner particles (with the slight coloration being the result of the PEDOT particle coating) were washed 6 times with distilled water and then dried with a freeze dryer for 48 hours. The chemical oxidative polymerization of EDOT to produce PEDOT occurred on the toner particle surfaces, and the particle surfaces were rendered slightly conductive by the presence of the sulfonate groups from the toner particle surfaces. The average particle size of the toner particles was 5.2 microns and the particle size distribution was 1.23. The bulk conductivity of this sample when pressed into a pellet was $3.8\times10^{-13}$ Siemens per centimeter. The triboelectric charge measured by the method and with the carrier described in Example VI was −8.8 microCoulombs per gram.

EXAMPLE VIII

Toner particles were prepared by aggregation of a styrene/n-butyl acrylate/styrene sulfonate sodium salt/acrylic acid latex using a flocculant (poly(aluminum chloride)) followed by particle coalescence at elevated temperature. The polymeric latex was prepared by the emulsion polymerization of styrene/n-butyl acrylate/styrene sulfonate sodium salt/acrylic acid (monomer ratio 81.5 parts by weight styrene, 18 parts by weight n-butyl acrylate, 0.5 parts by weight of styrene sulfonate sodium salt, 2 parts by weight acrylic acid) without a nonionic surfactant and without an anionic surfactant. The solution consisted of 40.0 percent by weight solids as follows; 277.92 kilograms of styrene, 61.38 kilograms of n-butyl acrylate, 1.7 kilograms of styrene sulfonate sodium salt, 6.52 kilograms of acrylic acid, 3.41 kilograms of carbon tetrabromide, and 11.2 kilograms of dodecanethiol were mixed with 461 kilograms of deionized water and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting self stabilized latex contained 59.5 percent by weight water and 40.5 percent by weight solids, which solids comprised particles of a random copolymer; the glass transition temperature of the latex dry sample was 48° C., as measured on a DuPont DSC. The latex had a weight average molecular weight of 30,600 and a number average molecular weight of 5,000 as determined with a Waters gel permeation chromatograph. The particle size of the latex as measured on a Disc Centrifuge was 278 nanometers.

From the latex thus prepared 50 grams was diluted with 100 milliliters of water in a 250 milliliter beaker for a solids loading of 20 grams. The pH of the slurry was not adjusted. Into this stirred solution was dissolved the oxidant ammonium persulfate (3.7 grams; 0.0162 mole). After 15 minutes, 2.0 grams (0.0141 mole) of 3,4-ethylenedioxythiophene monomer (EDOT) diluted in 5 milliliters of acetonitrile was added to the solution. The molar ratio of oxidant to EDOT was 1.1:1, and EDOT was present in an amount of 10 percent by weight of the toner particles. The reaction was stirred overnight at room temperature. The particles were then dried with a freeze dryer for 48 hours. The average particle size of the toner particles was in the nanometer size range. The bulk conductivity of this sample when pressed into a pellet was $1.3\times10^{-7}$ Siemens per centimeter. The triboelectric charge measured by the method and with the carrier described in Example VI was −3.6 microCoulombs per gram.

EXAMPLE IX

Unpigmented toner particles were prepared by the method described in Example VI. Into a 250 milliliter beaker was added 150 grams of a pigmentless toner size particle slurry (average particle diameter 5.7 microns; particle size distribution GSD 1.24) providing a total of 11.25 grams of solid material in the solution. The pH of the solution was then adjusted by adding the dopant para-toluene sulfonic acid (pTSA) until the pH was 2.73. Into this stirred solution was dissolved the oxidant ferric chloride (1.3 grams; 8.0 mmole). After 15 minutes, 0.45 grams (3.17 mmole) of 3,4-ethylenedioxythiophene monomer (EDOT) was added to the solution. The molar ratio of oxidant to EDOT was 2.5:1, and EDOT was present in an amount of 4 percent by weight of the toner particles. The reaction was stirred overnight at room temperature. The resulting greyish toner particles (with the slight coloration being the result of the PEDOT particle coating) were washed 6 times with distilled water and then dried with a freeze dryer for 48 hours. The chemical oxidative polymerization of EDOT to produce PEDOT occurred on the toner particle surfaces, and the particle surfaces were rendered slightly conductive by the presence of the sulfonate groups from the toner particle surfaces and by the added pTSA. The average particle size of the toner particles was 5.1 microns and the particle size distribution was 1.22. The bulk conductivity of this sample when pressed into a pellet was $1.7\times10^{-13}$ Siemens per centimeter. The triboelectric charge measured by the method and with the carrier described in Example VI was +15.8 microCoulombs per gram.

EXAMPLE X

Toner particles were prepared by aggregation of a styrene/n-butyl acrylate/styrene sulfonate sodium salt/acrylic acid latex using a flocculant (poly(aluminum chloride)) followed by particle coalescence at elevated temperature. The polymeric latex was prepared by the emulsion polymerization of styrene/n-butyl acrylate/styrene sulfonate sodium salt/acrylic acid (monomer ratio 81.5 parts by weight styrene, 18 parts by weight n-butyl acrylate, 0.5 parts by weight of styrene sulfonate sodium salt, 2 parts by weight acrylic acid) without a nonionic surfactant and without an anionic surfactant. The solution consisted of 40.0 percent by weight solids as follows; 277.92 kilograms of styrene, 61.38 kilograms of n-butyl acrylate, 1.7 kilograms of styrene sulfonate sodium salt, 6.52 kilograms of acrylic acid, 3.41 kilograms of carbon tetrabromide, and 11.2 kilograms of dodecanethiol were mixed with 461 kilograms of deionized water and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting self stabilized latex contained 59.5 percent by weight water and 40.5 percent by weight solids, which solids comprised particles of a random copolymer; the glass transition temperature of the latex dry sample was 48° C., as measured on a DuPont DSC. The latex had a weight average molecular weight of 30,600 and a number average molecular weight of 5,000 as determined with a Waters gel permeation chromatograph. The particle size of the latex as measured on a Disc Centrifuge was 278 nanometers.

From the latex thus prepared 50 grams was diluted with 100 milliliters of water in a 250 milliliter beaker for a solids loading of 20 grams. The pH of the slurry was not adjusted. Into this stirred solution was dissolved the oxidant ferric chloride (5.7 grams; 0.0352 mole). After 30 minutes, 2.0 grams (0.0141 mole) of 3,4-ethylenedioxythiophene monomer (EDOT) was added to the solution. The molar ratio of oxidant to EDOT was 2.5:1, and EDOT was present in an amount of 10 percent by weight of the toner particles. The reaction was stirred overnight at room temperature. The particles were then dried with a freeze dryer for 48 hours. The average particle size of the toner particles was in the nanometer size range. The bulk conductivity of this sample when pressed into a pellet was $3.5\times10^{-9}$ Siemens per centimeter. The triboelectric charge measured by the method and with the carrier described in Example VI was +4.1 mircroCoulombs per gram.

EXAMPLE XI

Toner particles were prepared by aggregation of a styrene/n-butyl acrylate/styrene sulfonate sodium salt/acrylic acid latex using a flocculant (poly(aluminum chloride)) followed by particle coalescence at elevated temperature. The polymeric latex was prepared by the emulsion polymerization of styrene/n-butyl acrylate/styrene sulfonate sodium salt/acrylic acid (monomer ratio 81.5 parts by weight styrene, 18 parts by weight n-butyl acrylate, 0.5 parts by weight of styrene sulfonate sodium salt, 2 parts by weight acrylic acid) without a nonionic surfactant and without an anionic surfactant. The solution consisted of 40.0 percent by weight solids as follows; 277.92 kilograms of styrene, 61.38 kilograms of n-butyl acrylate, 1.7 kilograms of styrene sulfonate sodium salt, 6.52 kilograms of acrylic acid, 3.41 kilograms of carbon tetrabromide, and 11.2 kilograms of dodecanethiol were mixed with 461 kilograms of deionized water and 3.41 kilograms of ammonium persulfate polymerization initiator dissolved in 50 kilograms of deionized water. The emulsion thus formed was polymerized at 70° C. for 3 hours, followed by heating to 85° C. for an additional 1 hour. The resulting self stabilized latex contained 59.5 percent by weight water and 40.5 percent by weight solids, which solids comprised particles of a random copolymer; the glass transition temperature of the latex dry sample was 48° C., as measured on a DuPont DSC. The latex had a weight average molecular weight of 30,600 and a number average molecular weight of 5,000 as determined with a Waters gel permeation chromatograph. The particle size of the latex as measured on a Disc Centrifuge was 278 nanometers.

From the latex thus prepared 50 grams was diluted with 100 milliliters of water in a 250 milliliter beaker for a solids loading of 20 grams. The pH of the slurry was not adjusted. Into this stirred solution was dissolved the oxidant ferric chloride (1.15 grams; 7.09 mmole). After 15 minutes, 2.0 grams (0.0141 mole) of 3,4-ethylenedioxythiophene monomer (EDOT) was added to the solution. The molar ratio of oxidant to EDOT was 0.5:1, and EDOT was present in an amount of 10 percent by weight of the toner particles. The reaction was stirred overnight at room temperature. The particles were then dried with a freeze dryer for 48 hours. The average particle size of the toner particles was in the nanometer size range. The bulk conductivity of this sample when pressed into a pellet was $1.5\times10^{-7}$ Siemens per centimeter. The triboelectric charge measured by the method and with the carrier described in Example VI was +7.1 mircroCoulombs per gram.

EXAMPLE XIII

A Ballistic Aerosol Marking (BAM) printing test fixture is built wherein toner particles are ejected from BAM venturi structure pipes onto a substrate for direct marking studies. The substrate moves at 0.4 millimeters per second. A cylinder of dry compressed gas (either nitrogen or ambient air) equipped with a gas regulator and gas line is split into two streams by a second pressure regulator. The toner supply air line is reduced in pressure using a third gas pressure regulator which has an operating range from 0 to 50 psi. This air supply is fed into a BAM toner flow cell used to fluidize the toner and create an aerosol toner stream into the toner compartment which continuously gates toner into the BAM venturi pipes.

About 1 to 3 grams of toner is placed on top of a porous glass frit inside the BAM flow cell device of the print test fixture. This flow cell consists of a cylindrical hollow column of plexiglass about 8 centimeters tall by 6 centimeters in diameter containing two porous glass frits. The toner is placed on the lower glass frit, which is about 4 centimeters from the bottom. The second glass frit is part of the removable top portion. A piezo actuator is also present in the flow cell to help produce a continuous aerosol stream of toner. The low pressure gas supply line is connected at the bottom of the flow cell and gas is evenly distributed through the lower glass frit to create a fluidized bed of toner in the gas stream. In the toner portion of the device is attached a 1/32 inch diameter tube which is then connected to the toner reservoir hose barb of the BAM print head which contains the venturi structure BAM pipes. The fluidized toner is continuously ejected into the BAM pipes through this connecting tube.

The second gas stream operating at much higher pressures ranging from 20 to 100 psi is fed into the BAM venturi structure pipes through a 1/32 inch tube connected to the BAM print head by a hose barb. The BAM printing chip is clamped in place at 1 millimeter distance from the substrate. The toner is ejected from the BAM channels in a horizontal direction onto a substrate moving in either a horizontal or vertical direction which is controlled by a Newport Universal Motion Controller/Driver model ESP 300. After capturing all of the toner on a substrate the print quality of the lines are evaluated using an optical microscope and the line width and toner scatter about the line is determined.

The toners of Examples I through XI are incorporated into this test fixture and used to generate images. It is believed that the toners will perform well, that they will exhibit minimal or no clogging of the printing channels, and that they will generate images of desirable quality.

Other embodiments and modifications of the present to invention may occur to those of ordinary skill in the art subsequent to a review of the information presented herein; these embodiments and modifications, as well as equivalents thereof are also included within the scope of this invention.

What is claimed is:

1. A process for depositing marking material onto a substrate which comprises (a) providing a propellant to a head structure, said head structure having at least one channel therein, said channel having an exit orifice with a width no larger than about 250 microns through which the propellant can flow, said propellant flowing through the channel to form thereby a propellant stream having kinetic energy, said channel directing the propellant stream toward the substrate, and (b) controllably introducing a particulate marking material into the propellant stream in the channel, wherein the kinetic energy of the propellant particle stream causes the particulate marking material to impact the substrate, and wherein the particulate marking material comprises toner particles which comprise a vinyl resin, an optional colorant, and poly(3,4-ethylenedioxythiophene), said toner particles having an average particle diameter of no more than about 10 microns and a particle size distribution of GSD equal to no more than about 1.25, wherein said toner particles are prepared by an emulsion aggregation process, said toner particles having an average bulk conductivity of at least about $10^{-11}$ Siemens per centimeter.

2. A process according to claim 1 wherein the toner particles have an average particle diameter of no more than about 7 microns.

3. A process according to claim 1 wherein the toner particles comprise a core comprising the vinyl resin and optional colorant and, coated on the core, a coating comprising the poly(3,4-ethylenedioxythiophene).

4. A process according to claim 1 wherein the vinyl resin is a polymer of monomers selected from the group consisting of styrenes, acrylates, methacrylates, vinyl acrylic acids, butadiene, isoprene, and mixtures thereof.

5. A process according to claim 1 wherein the vinyl resin is a polymer of monomers selected from the group consisting of styrene, p-methyl styrene, m-methyl styrene, α-methyl styrene, methyl acrylate, ethyl acrylate, propyl acrylate, butyl acrylate, β-carboxyethyl acrylate, methyl methacrylate, ethyl methacrylate, propyl methacrylate, butyl methacrylate, acrylic acid, methacrylic acid, butadiene, isoprene, styrene sulfonic acid and salts thereof, 4-vinylbenzene sulfonic acid and salts thereof, vinylsulfonic acid and salts thereof, 2-acrylamido-N-methylpropane sulfonic acid and salts thereof, vinyl-1-pyridinium propane sulfonate and salts thereof, and mixtures thereof.

6. A process according to claim 1 wherein the vinyl resin is selected from the group consisting of poly(styrene/butadiene), poly(p-methyl styrene/butadiene), poly(m-methyl styrene/butadiene), poly(α-methyl styrene/butadiene), poly(methyl methacrylate/butadiene), poly(ethyl methacrylate/butadiene), poly(propyl methacrylate/butadiene), poly(butyl methacrylate/butadiene), poly (methyl acrylate/butadiene), poly(ethyl acrylate/butadiene), poly(propyl acrylate/butadiene), poly(butyl acrylate/butadiene), poly(styrene/isoprene), poly(p-methyl styrene/isoprene), poly(m-methyl styrene/isoprene), poly(α-methyl styrene/isoprene), poly(methyl methacrylate/isoprene), poly (ethyl methacrylate/isoprene), poly(propyl methacrylate/isoprene), poly(butyl methacrylate/isoprene), poly(methyl acrylate/isoprene), poly(ethyl acrylate/isoprene), poly (propyl acrylate/isoprene), poly(butylacrylate-isoprene), poly(styrene/n-butyl acrylate/acrylic acid), poly(styrene/n-butyl methacrylate/acrylic acid), poly(styrene/n-butyl methacrylate/β-carboxyethyl acrylate), poly(styrene/n-butyl acrylate/β-carboxyethyl acrylate) poly(styrene/butadiene/methacrylic acid), poly(styrene/n-butyl acrylate/styrene sulfonate sodium salt/acrylic acid), and mixtures thereof.

7. A process according to claim 1 wherein the resin is present in the toner particles in an amount of at least about 75 percent by weight of the toner particles and wherein the resin is present in the toner particles in an amount of no more than about 99 percent by weight of the toner particles.

8. A process according to claim 1 wherein the toner particles further comprise a pigment colorant.

9. A process according to claim 1 wherein the toner particles contain a colorant, said colorant being present in an amount of at least about 1 percent by weight of the toner particles, and said colorant being present in an amount of no more than about 25 percent by weight of the toner particles.

10. A process according to claim 1 wherein the emulsion aggregation process comprises (1) shearing a first ionic surfactant with a latex mixture comprising (a) a counterionic surfactant with a charge polarity of opposite sign to that of said first ionic surfactant, (b) a nonionic surfactant, and (c) a vinyl resin, thereby causing flocculation or heterocoagulation of formed particles of resin to form electrostatically bound aggregates; and (2) heating the electrostatically bound aggregates to form aggregates of at least about 1 micron in average particle diameter.

11. A process according to claim 1 wherein the emulsion aggregation process comprises (1) preparing a colorant dispersion in a solvent, which dispersion comprises a colorant and a first ionic surfactant; (2) shearing the colorant dispersion with a latex mixture comprising (a) a counterionic surfactant with a charge polarity of opposite sign to that of said first ionic surfactant, (b) a nonionic surfactant, and (c) a vinyl resin, thereby causing flocculation or heterocoagulation of formed particles of colorant and resin to form electrostatically bound aggregates; and (3) heating the electrostatically bound aggregates to form aggregates of at least about 1 micron in average particle diameter.

12. A process according to claim 1 wherein the emulsion aggregation process comprises (1) shearing an ionic surfactant with a latex mixture comprising (a) a flocculating agent, (b) a nonionic surfactant, and (c) a vinyl resin, thereby causing flocculation or heterocoagulation of formed particles of colorant and resin to form electrostatically bound aggregates; and (2) heating the electrostatically bound aggregates to form aggregates of at least about 1 micron in average particle diameter.

13. A process according to claim 1 wherein the emulsion aggregation process comprises (1) preparing a colorant dispersion in a solvent, which dispersion comprises a colorant and an ionic surfactant; (2) shearing the colorant dispersion with a latex mixture comprising (a) a flocculating agent, (b) a nonionic surfactant, and (c) a vinyl resin, thereby causing flocculation or heterocoagulation of formed particles of colorant and resin to form electrostatically bound aggregates; and (3) heating the electrostatically bound aggregates to form aggregates of at least about 1 micron in average particle diameter.

14. A process according to claim 1 wherein the poly(3,4-ethylenedioxythiophene) is formed from monomers of the formula

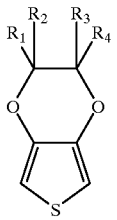

wherein each of $R_1$, $R_2$, $R_3$, and $R_4$, independently of the others, is a hydrogen atom, an alkyl group, an alkoxy group, an aryl group, an aryloxy group, an arylalkyl group, an alkylaryl group, an arylalkyloxy group, an alkylaryloxy group, or a heterocyclic group.

15. A process according to claim 14 wherein $R_1$ and $R_3$ are hydrogen atoms and $R_2$ and $R_4$ are (a) $R_2$=H, $R_4$=H; (b) $R_2=(CH_2)_nCH_3$ wherein n=0–14, $R_4$=H; (c) $R_2=(CH_2)_nCH_3$ wherein n=0–14, $R_4=(CH_2)_nCH_3$ wherein n=0–14; (d) $R_2=(CH_2)_nSO_3_Na^+$ wherein n=1–6, $R_4$=H; (e) $R_2=(CH_2)_nSO_3—Na^+$ wherein n=1–6, $R_4=(CH_2)_nSO_3—Na^+$ wherein n=1–6; (f) $R_2=(CH_2)_nOR_6$ wherein n=0–4 and $R_6$=(i) H or (ii) $(CH_2)_mCH_3$ wherein m=0–4, $R_4$=H; or (g) $R_2=(CH_2)_nOR_6$ wherein n=0–4 and $R_6$=(i) H or (ii) $(CH_2)_mCH_3$ wherein m=0–4, $R_4=(CH_2)_nOR_6$ wherein n=0–4 and $R_6$=(i) H or (ii) $(CH_2)_mCH_3$ wherein m=0–4.

16. A process according to claim 1 wherein the poly(3,4-ethylenedioxythiophene) is of the formula

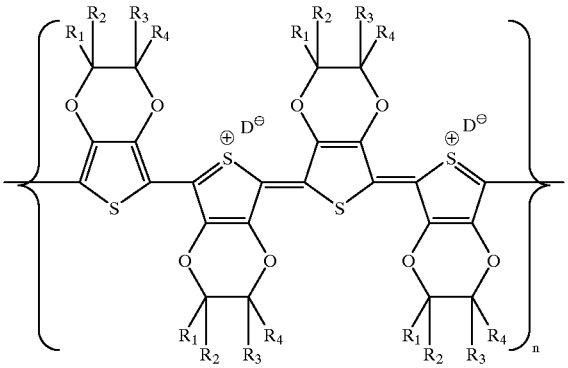

wherein each of $R_1$, $R_2$, $R_3$, and $R_4$, independently of the others, is a hydrogen atom, an alkyl group, an alkoxy group, an aryl group, an aryloxy group, an arylalkyl group, an alkylaryl group, an arylalkyloxy group, an alkylaryloxy group, or a heterocyclic group, $D^-$ is a dopant moiety, and n is an integer representing the number of repeat monomer units.

17. A process according to claim 1 wherein the poly(3,4-ethylenedioxythiophene) has at least about 3 repeat monomer units.

18. A process according to claim 1 wherein the poly(3,4-ethylenedioxythiophene) has at least about 6 repeat monomer units and wherein the poly(3,4-ethylenedioxythiophene) has no more than about 100 repeat monomer units.

19. A process according to claim 1 wherein the poly(3,4-ethylenedioxythiophene) is doped with a dopant selected from the group consisting of iodine, molecules containing sulfonate groups, molecules containing phosphate groups, molecules containing phosphonate groups, and mixtures thereof.

20. A process according to claim 1 wherein the poly(3,4-ethylenedioxythiophene) is doped with sulfonate containing anions of the formula $RSO_3^-$ wherein R is an alkyl group, an alkoxy group, an aryl group, an aryloxy group, an arylalkyl group, an alkylaryl group, an arylalkyloxy group, an alkylaryloxy group, or mixtures thereof.

21. A process according to claim 1 wherein the poly(3,4-ethylenedioxythiophene) is doped with anions selected from the group consisting of p-toluene sulfonate, camphor sulfonate, benzene sulfonate, naphthalene sulfonate, dodecyl sulfonate, dodecylbenzene sulfonate, dialkyl benzenealkyl sulfonates, para-ethylbenzene sulfonate, alkyl naphthalene sulfonates, poly(styrene sulfonate), and mixtures thereof.

22. A process according to claim 1 wherein the poly(3, 4-ethylenedioxythiophene) is doped with anions selected from the group consisting of p-toluene sulfonate, camphor sulfonate, benzene sulfonate, naphthalene sulfonate, dodecyl sulfonate, dodecylbenzene sulfonate, 1,3benzene disulfonate, para-ethylbenzene sulfonate, 1,5naphthalene disulfonate, 2-naphthalene disulfonate, poly(styrene sulfonate), and mixtures thereof.

23. A process according to claim 1 wherein the poly(3, 4-ethylenedioxythiophene) is doped with a dopant present in an amount of at least about 0.1 molar equivalent of dopant per molar equivalent of 3,4-ethylenedioxythiophene monomer and present in an amount of no more than about 5 molar equivalents of dopant per molar equivalent of 3,4-ethylenedioxythiophene monomer.

24. A process according to claim 1 wherein the poly(3, 4-ethylenedioxythiophene) is doped with a dopant present in an amount of at least about 0.25 molar equivalent of dopant per molar equivalent of 3,4-ethylenedioxythiophene monomer and present in an amount of no more than about 4 molar equivalents of dopant per molar equivalent of 3,4-ethylenedioxythiophene monomer.

25. A process according to claim 1 wherein the poly(3, 4-ethylenedioxythiophene) is doped with a dopant present in an amount of at least about 0.5 molar equivalent of dopant per molar equivalent of 3,4-ethylenedioxythiophene monomer and present in an amount of no more than about 3 molar equivalents of dopant per molar equivalent of 3,4-ethylenedioxythiophene monomer.

26. A process according to claim 1 wherein the toner particles have an average bulk conductivity of no more than about 10 Siemens per centimeter.

27. A process according to claim 1 wherein the toner particles have an average bulk conductivity of no more than about $10^{-7}$ Siemens per centimeter.

28. A process according to claim 1 wherein the poly(3, 4-ethylenedioxythiophene) is present in an amount of at least about 5 weight percent of the toner particle mass and wherein the poly(3,4-ethylenedioxythiophene) is present in an amount of no more than about 20 weight percent of the toner particle mass.

29. A process according to claim 1 wherein the toner particles exhibit interparticle cohesive forces of no more than about 20 percent.

30. A process according to claim 1 wherein the toner particles exhibit interparticle cohesive forces of no more than about 10 percent.

31. A process according to claim 1 wherein each said channel has a converging region and a diverging region, and wherein said propellant is introduced in said converging region and flows into said diverging region, whereby said propellant is at a first velocity and first pressure in said converging region and a second velocity and a second pressure in said diverging region, said first pressure greater than said second pressure and said first velocity less than said second velocity.

* * * * *